US009107500B2

(12) United States Patent
Zimmermann

(10) Patent No.: US 9,107,500 B2
(45) Date of Patent: Aug. 18, 2015

(54) EXTRACTION GUIDE

(71) Applicant: Schock Metallwerk GmbH, Urbach (DE)

(72) Inventor: Joachim Zimmermann, Schorndorf (DE)

(73) Assignee: Schock Metallwerk GmbH, Urbach (DE)

( * ) Notice: Subject to any disclaimer, the term of this patent is extended or adjusted under 35 U.S.C. 154(b) by 0 days.

(21) Appl. No.: 14/164,571

(22) Filed: Jan. 27, 2014

(65) Prior Publication Data

US 2014/0167589 A1 Jun. 19, 2014

Related U.S. Application Data

(63) Continuation of application No. PCT/EP2012/062564, filed on Jun. 28, 2012.

(30) Foreign Application Priority Data

Aug. 9, 2011 (DE) ..... 10 2011 052 524

(51) Int. Cl.
*A47B 88/00* (2006.01)
*A47B 88/04* (2006.01)
*A47B 88/10* (2006.01)

(52) U.S. Cl.
CPC ..... *A47B 88/0466* (2013.01); *A47B 88/047* (2013.01); *A47B 88/0477* (2013.01); *A47B 88/10* (2013.01)

(58) Field of Classification Search
CPC ..... A47B 88/047; A47B 88/0466; A47B 88/0477; A47B 88/10
USPC ..... 312/334.1, 334.7, 334.8, 334.11, 312/334.27, 334.29, 334.31–334.34, 312/334.38, 333, 334.44; 384/18, 21
See application file for complete search history.

(56) References Cited

U.S. PATENT DOCUMENTS

| | | | | |
|---|---|---|---|---|
| 3,039,838 | A | | 6/1962 | Koch, Jr. et al. |
| 3,857,618 | A | * | 12/1974 | Hagen et al. ..... 384/18 |
| 4,469,384 | A | | 9/1984 | Fler et al. |
| 4,799,802 | A | * | 1/1989 | Lautenschlager ..... 384/19 |
| 5,181,782 | A | | 1/1993 | Wojcik |
| 5,207,781 | A | * | 5/1993 | Rock ..... 312/319.1 |

(Continued)

FOREIGN PATENT DOCUMENTS

| | | |
|---|---|---|
| DE | 30 05 817 | 9/1980 |
| DE | 691 05 678 | 4/1995 |

(Continued)

*Primary Examiner* — Janet M Wilkens
(74) *Attorney, Agent, or Firm* — Lipsitz & McAllister, LLC

(57) ABSTRACT

A drawer guide is provided for displaceable arrangement of a drawer configured to be pulled out from a carcass. The drawer guide has at least two guide rails, which are displaceable relative to one another by means of rolling elements, and at least one functional device for influencing a relative movement of at least one of the at least two guide rails relative to at least one further one of the at least two guide rails. At least two substantially C-shaped guide rails are provided, which each have a rail back which connects at least two legs to one another, on which, in each case, at least one rolling element track is configured. The at least two C-shaped guide rails are arranged with the rail backs facing away from one another. At least one receiving element is provided to at least partially receive the at least one functional device.

15 Claims, 16 Drawing Sheets

(56) References Cited

U.S. PATENT DOCUMENTS

| | | | | |
|---|---|---|---|---|
| 5,417,489 | A | 5/1995 | Compagnucci | |
| 5,951,132 | A | 9/1999 | Cirocco | |
| 6,244,678 | B1 | 6/2001 | Dopp et al. | |
| 6,789,861 | B1 | 9/2004 | Dobberstein | |
| 6,789,862 | B2 | 9/2004 | Shih-Long et al. | |
| 6,854,379 | B2 | 2/2005 | Pattle et al. | |
| 6,942,307 | B1 * | 9/2005 | Lammens | 312/334.46 |
| 7,316,179 | B2 | 1/2008 | Geberzahn et al. | |
| 7,384,108 | B2 * | 6/2008 | Lam et al. | 312/334.44 |
| 7,641,296 | B2 * | 1/2010 | Le | 312/333 |
| 7,798,583 | B2 | 9/2010 | Yang et al. | |
| 7,845,744 | B2 | 12/2010 | Chen et al. | |
| 7,942,486 | B2 | 5/2011 | Petri | |
| 8,827,388 | B2 * | 9/2014 | Johansson et al. | 312/333 |
| 2002/0033658 | A1 * | 3/2002 | Salice | 312/334.14 |
| 2003/0006682 | A1 * | 1/2003 | Hoffman | 312/334.1 |
| 2003/0067257 | A1 * | 4/2003 | Gasser | 312/331 |
| 2003/0079615 | A1 | 5/2003 | Pattle et al. | |
| 2003/0209958 | A1 | 11/2003 | Hwang et al. | |
| 2004/0000850 | A1 | 1/2004 | Lam Harn et al. | |
| 2004/0003726 | A1 | 1/2004 | Geberzahn et al. | |
| 2005/0074190 | A1 | 4/2005 | Traiser et al. | |
| 2007/0126324 | A1 | 6/2007 | Lee | |
| 2007/0222346 | A1 * | 9/2007 | Kleinsasser | 312/205 |
| 2007/0261199 | A1 | 11/2007 | Petri | |
| 2008/0284299 | A1 | 11/2008 | Chen et al. | |
| 2010/0296758 | A1 * | 11/2010 | Johansson | 384/18 |
| 2011/0142380 | A1 | 6/2011 | Jeakings | |
| 2013/0026899 | A1 * | 1/2013 | Babucke-Runte et al. | 312/334.1 |
| 2014/0021840 | A1 * | 1/2014 | Radusin | 312/319.1 |
| 2014/0152165 | A1 * | 6/2014 | Zimmermann | 312/333 |

FOREIGN PATENT DOCUMENTS

| | | |
|---|---|---|
| DE | 694 06 715 | 6/1998 |
| DE | 103 40 482 | 4/2005 |
| DE | 20 2005 013 789 | 12/2005 |
| DE | 10 2004 057 714 | 6/2006 |
| DE | 10 2005 002 315 | 7/2006 |
| DE | 10 2006 057 582 | 7/2007 |
| DE | 10 2006 007 978 | 8/2007 |
| DE | 20 2007 011 533 | 12/2007 |
| DE | 199 11 312 | 2/2008 |
| DE | 20 2008 000 887 | 4/2008 |
| DE | 20 2006 019 009 | 5/2008 |
| DE | 10 2010 036 902 | 2/2011 |
| DE | 20 2011 051 895 | 1/2012 |
| DE | 10 2010 043 422 | 5/2012 |
| DE | 10 2011 004 889 | 9/2012 |
| DE | 10 2011 051 138 | 12/2012 |
| EP | 0 476 745 | 3/1992 |
| EP | 0 626 143 | 11/1994 |
| EP | 1 225 806 | 4/2004 |
| EP | 1 327 109 | 12/2004 |
| EP | 1 306 622 | 9/2005 |
| EP | 1 243 203 | 8/2006 |
| EP | 1 277 422 | 10/2006 |
| EP | 1 502 521 | 10/2006 |
| EP | 1 571 357 | 8/2007 |
| EP | 1 607 685 | 8/2007 |
| EP | 1 662 159 | 3/2010 |
| EP | 2 160 960 | 3/2010 |
| EP | 1 532 402 | 12/2010 |
| EP | 2 325 565 | 5/2011 |
| EP | 1 642 066 | 10/2011 |
| EP | 2 487 422 | 8/2012 |
| EP | 2 532 273 | 12/2012 |
| EP | 2 532 976 | 12/2012 |
| JP | 2010 104 735 | 5/2010 |
| JP | 2011024665 | 2/2011 |
| WO | WO 2006/000523 | 1/2006 |
| WO | WO 2007/111424 | 10/2007 |
| WO | WO 2009/150434 | 12/2009 |
| WO | WO 2010/089553 | 8/2010 |
| WO | WO 2012/025717 | 3/2012 |

* cited by examiner

EXTRACTION GUIDE

RELATED APPLICATION

This application is a continuation of International application No. PCT/EP2012/062564 filed on Jun. 28, 2012, and claims the benefit of German application number 10 2011 052 524.6 filed on Aug. 9, 2011, which are incorporated herein by reference in their entirety and for all purposes.

FIELD OF DISCLOSURE

The present invention relates to a drawer guide for the displaceable arrangement of a drawer, which is configured to be pulled out of a carcass in a pull-out direction, which drawer guide comprises at least two guide rails, which are displaceable relative to one another along the pull-out direction by means of rolling elements, at least two substantially C-shaped guide rails being provided, which, in each case, have a rail back, which connects at least two legs to one another, on which at least one rolling element track is configured in each case, at least two C-shaped guide rails being arranged in such a way that their rail backs are arranged facing away from one another. Furthermore, the drawer guide comprises at least one functional device for influencing a relative movement of at least one of the at least two guide rails relative to at least one further one of the at least two guide rails.

BACKGROUND

A functional device of a drawer guide, for example a self-closing device and/or a damping device, may, for example, be arranged separately from the drawer guide on the carcass or on the drawer. However, this separate arrangement increases the outlay for assembly of the combination of the drawer guide and functional device on a carcass and/or a drawer.

The present invention is based on the object of providing a drawer guide, which is compact and is configured to be assembled with a low assembly outlay.

SUMMARY OF THE INVENTION

This object is achieved according to the invention in that the drawer guide comprises at least one receiving element to at least partially receive at least one functional device, at least one receiving element being arranged on an outer side, which faces away from the legs of a guide rail, of a rail back of a guide rail and/or on an outer side, which faces away from the at least one rolling element track, of a leg of a guide rail.

Since the drawer guide comprises at least one receiving element to at least partially receive at least one functional device, a functional device can be particularly easily arranged on a guide rail of the drawer guide.

In one configuration of the invention it is provided that at least one receiving element is arranged on an outer side, which faces away from the legs of the guide rail, of a rail back of a guide rail. As a result, at least one receiving element can already be arranged on the guide rails of the drawer guide before the drawer guide is arranged on a carcass and/or a drawer.

Alternatively or in addition to this, it may be provided that at least one receiving element is arranged on an outer side, which faces away from the at least one rolling element track, of a leg of a guide rail. Also as a result of this, at least one receiving element can already be arranged on the guide rails of the drawer guide before the drawer guide is arranged on a carcass and/or a drawer.

It can basically be provided that the at least two C-shaped guide rails, the rail backs of which are arranged facing away from one another, are arranged directly adjacent to one another, for example are guided on one another by means of rolling elements. As an alternative to this, however, it may also be provided that the at least two C-shaped guide rails, the rail backs of which are arranged facing away from one another, are not guided on one another and/or not arranged in a directly adjacent manner.

Thus, it may, for example, be provided that two C-shaped guide rails, the rail backs of which are arranged facing away from one another, are formed by a carcass-side or a drawer-side guide rail, on the one hand, and a centre rail, on the other hand. As an alternative or in addition to this, it may be provided that two C-shaped guide rails, the rail backs of which are arranged facing away from one another, are formed by a carcass-side guide rail and a drawer-side guide rail.

In this description and the accompanying claims, a functional device is to be taken to mean any device, by means of which a relative movement of at least one guide rail relative to at least one further guide rail can be influenced, for example accelerated and/or decelerated. In particular, this may be a pull-in device to automatically pull in the drawer guide from an at least partially pulled-out state into the completely inserted state. Furthermore, this may be a damping device for damping a movement, in particular an insertion movement, of a drawer-side guide rail arranged on the drawer in the assembled state of the drawer guide relative to a carcass-side guide rail arranged on the carcass in the assembled state of the drawer guide.

In one configuration of the invention it is provided that at least one receiving element, in the assembled state of the drawer guide, is at least partially arranged between two vertical limiting planes in the assembled state of the drawer guide, which limiting planes run parallel to one another and parallel to the pull-out direction, a first limiting plane of the two limiting planes running through a first point, which is located furthest to the left, viewed in the pull-out direction, of a guide rail of the drawer guide and the second limiting plane of the two limiting planes running through a second point, which is located furthest to the right, viewed in the pull-out direction, of a guide rail of the drawer guide. A compact arrangement of the drawer guide is thus possible between a carcass and a drawer.

Alternatively or in addition to this, it may be provided that at least one receiving element, in the assembled state of the drawer guide, is at least partially arranged between two horizontal limiting planes in the assembled state of the drawer guide, which limiting planes run parallel to one another and parallel to the pull-out direction, a first limiting plane of the two limiting planes running through a first point, which is located furthest up, viewed in the pull-out direction, of a guide rail of the drawer guide and the second limiting plane of the two limiting planes running through a second point, which is located furthest down, viewed in the pull-out direction, of a guide rail of the drawer guide.

Furthermore, as an alternative or in addition to this, it may be provided that at least one receiving element is at least partially arranged between two limiting planes, which run parallel to one another, parallel to the pull-out direction and parallel to a longitudinal plane running through the free edges of two legs of a guide rail, a first limiting plane of the two limiting planes running through a first point, which is spaced apart the furthest from the longitudinal plane, of a guide rail on a first side of the longitudinal plane and the second limiting plane of the two limiting planes running through a second point, which is spaced apart the furthest from the longitudinal plane, of a guide rail on a second side of the longitudinal plane opposite the first side of the longitudinal plane.

It may basically be provided that the points, through which the limiting planes run, are arranged on the same guide rail or guide rails that are different from one another.

It may be provided, for example, that a first point of a first limiting plane is arranged on a carcass-side guide rail and a second point of the second limiting plane is arranged on a drawer-side guide rail.

Furthermore, it may be provided that the points, through which the limiting planes run, are arranged on a carcass-side guide rail, on a drawer-side guide rail or on a centre rail of the drawer guide.

In one configuration of the invention it is provided that at least one receiving element, in the assembled state of the drawer guide, in the horizontal direction, is arranged, at least in portions, between a rail back of a carcass-side guide rail configured to be arranged on the carcass, on the one hand, and a rail back of a drawer-side guide rail configured to be arranged on the drawer, on the other hand. A horizontal spacing of the drawer from the carcass in the region of the drawer guide can thus be minimised. A statement about the vertical arrangement of at least one portion of the at least one receiving element relative to the rail back of the carcass-side guide rail and the rail back of the drawer-side guide rail is not connected to this. Instead, it may preferably be provided that at least one portion of the receiving element, in the assembled state of the drawer guide, in the horizontal direction, is arranged between a rail back of a carcass-side guide rail configured to be arranged on the carcass, on the one hand, and a rail back of a drawer-side guide rail configured to be arranged on the drawer, on the other hand, and the same portion is at the same time arranged above or below the rail back of the carcass-side guide rail and/or the rail back of the drawer-side guide rail.

It may be favourable if at least one receiving element has a substantially L-shaped cross-section taken perpendicular to the pull-out direction.

As an alternative or in addition to this, it may be provided that at least one receiving element is substantially cuboidal.

At least one receiving element preferably at least partially surrounds at least one receiving space and is preferably provided with an access opening, through which, in the assembled state of the drawer guide, at least one actuating element extends to actuate at least one functional device. Since at least one receiving element at least partially surrounds at least one receiving space, at least one functional device can be particularly easily arranged on the at least one receiving element.

In particular, it may be provided that at least one actuating element for actuating at least one functional device, in the assembled state of the drawer guide, projects out of the receiving space.

It may be advantageous if at least one access opening for at least one receiving space is formed in an upper or a lower limiting wall of the receiving element, which limiting wall upwardly or downwardly limits the receiving space in the assembled state of the drawer guide in the vertical direction.

As an alternative or in addition to this, it may be provided that at least one access opening for at least one receiving space is formed in a lateral limiting wall of the receiving element, which laterally limits the receiving space, in the assembled state of the drawer guide, in the horizontal direction. In particular, it may be provided that at least one access opening for at least one receiving space is formed in a lateral limiting wall of the receiving element, which faces the drawer or the carcass in the assembled state of the drawer guide.

In one configuration of the invention it is provided that at least one actuating element is movable along the access opening to actuate at least one functional device in the assembled state of the drawer guide.

At least one access opening preferably extends along the pull-out direction. At least one actuating element is then preferably movable along the pull-out direction.

It may be favourable if the drawer guide comprises rolling elements made of a metallic material, in particular of steel, and/or rolling elements made of a plastics material in order to mount at least one of the at least two guide rails on at least one further one of the at least two guide rails.

In particular, it may be provided that rolling elements made of a metallic material, in particular from steel, and rolling elements made of a plastics material are provided mixed for a row of rolling elements to be arranged between two rolling element tracks.

At least two rolling elements are preferably held relative to one another in a predetermined relative position by means of rolling element cages.

The drawer guide preferably comprises at least one entrainer element, which is configured to be made to engage with at least one actuating element to actuate at least one functional device.

At least one receiving element on the one hand, and at least one entrainer element, on the other hand, are preferably arranged on guide rails of the drawer guide, which are different from one another. A relative movement of at least one of the at least two guide rails relative to at least one further one of the at least two guide rails can be particularly easily influenced in this manner by means of the at least one functional device.

It may be advantageous if at least one entrainer element is arranged on at least one rail back of at least one guide rail and/or on at least one leg, for example on at least an outer side, which faces away from the at least one rolling element track, of at least one leg of at least one guide rail.

In one configuration of the invention it is provided that at least one entrainer element, in the assembled state of the drawer guide, is at least partially arranged between two vertical limiting planes in the assembled state of the drawer guide, which limiting planes run parallel to one another and parallel to the pull-out direction, a first limiting plane of the two limiting planes running through a first point, which is located furthest to the left, viewed in the pull-out direction, of a guide rail of the drawer guide and the second limiting plane of the two limiting planes running through a second point, which is located furthest to the right, viewed in the pull-out direction, of a guide rail of the drawer guide.

As an alternative or in addition to this, it may be provided that at least one entrainer element, in the assembled state of the drawer guide, is at least partially arranged between two horizontal limiting planes in the assembled state of the drawer guide, which run parallel to one another and parallel to the pull-out direction, a first limiting plane of the two limiting planes running through a first point, which is located furthest up, viewed in the pull-out direction, of a guide rail of the drawer guide and the second limiting plane of the two limiting planes running through a second point, which is located furthest down, viewed in the pull-out direction, of a guide rail of the drawer guide.

Furthermore, as an alternative or in addition to this, it may be provided that at least one entrainer element is at least partially arranged between two limiting planes, which run parallel to one another, parallel to the pull-out direction and parallel to a longitudinal plane running through the free edges of two legs of a guide rail, a first limiting plane of the two limiting planes running through a first point, which is spaced apart the furthest from the longitudinal plane, of a guide rail on a first side of the longitudinal plane and the second limiting plane of the two limiting planes running through a second point, which is spaced apart the furthest from the longitudinal plane, of a guide rail on a second side of the longitudinal plane opposite the first side of the longitudinal plane.

It may be provided, in particular, that at least one entrainer element is arranged, at least in portions, between the same limiting planes as at least one receiving element of the drawer guide.

In one configuration of the invention it is provided that at least one entrainer element, in the assembled state of the drawer guide, is arranged, at least in portions, above or below all the rolling element tracks of the drawer guide.

In particular, it may be provided that at least one entrainer element, in the assembled state of the drawer guide, is arranged, at least in portions, vertically below or vertically above all the rolling element tracks of the drawer guide. In this way, the at least one entrainer element is configured to be made to engage particularly easily with the actuating element preferably arranged, at least in portions, above or below all the rolling element tracks of the drawer guide.

It may be favourable if at least one receiving element cooperates with at least one component of the functional device to influence the relative movement of at least one of the at least two guide rails relative to at least one further one of the at least two guide rails.

In this description and the accompanying claims, cooperation is taken to mean here a functional interaction, which goes beyond a mere holding or fixing of the functional device by means of the at least one receiving element.

It may, in particular, be provided here that at least one receiving element is provided with at least one guide path (guideway), by means of which at least one actuating element of at least one functional device is displaceably guided.

As an alternative or in addition to this, it may be provided that at least one receiving element forms a housing configured to be used to selectively receive different embodiments of functional devices.

A housing configured to be used for the selective receiving of various versions of functional devices, in this description and the accompanying claims, is taken to mean, in particular, a housing, in which different types of functional devices are configured to be selectively arranged. In particular, these are to be taken to mean functionally the same functional devices, for example two pull-in devices, which differ from one another, for example, merely with respect to their spring strength and therefore the effective pull-in forces. Furthermore, various types of functional devices are to be taken to mean functionally different functional devices, for example pull-in devices and damping devices, which can be selectively received in the at least one receiving element.

At least one receiving element therefore preferably forms a housing that is universally usable for various types or sorts of functional devices.

The drawer guide according to the invention is suitable, in particular, for use in a refrigerating appliance, a freezing appliance, a dishwasher or an oven, in other words, in general, in a so-called "white goods" appliance (domestic appliances for cooking, baking, etc.), but also in every other application, in which a drawer, a tray or the like has to be moved.

The drawer guide preferably comprises a mixture of rolling elements made of a plastics material and rolling elements made of a metallic material, in particular from steel.

In one configuration of the invention it is provided that the drawer guide comprises a support device for supporting at least one receiving element, at least one entrainer element and/or at least one actuating element.

The drawer guide preferably comprises a support device for supporting at least one receiving element, at least one entrainer element and/or at least one actuating element on the carcass, on the drawer and/or on at least one guide rail of the drawer guide.

In particular when the drawer guide is not arranged directly on a carcass, in particular a carcass wall of a carcass, or a drawer, in particular a drawer wall of a drawer, at least one support device may be advantageous to stabilise the drawer guide.

For example when a drawer is brought into the inserted state at a high speed and/or with a high load, a high degree of force is transmitted by an entrainer element onto an actuating element. If this force is too great to be absorbed by the receiving element, the receiving element may be deformed. In particular, a lateral evasion movement of the entrainer element relative to the actuating element may result from this. This may ultimately lead to faulty functioning of the drawer guide. A stabilisation of the drawer guide can be achieved by means of a support device, so that, in particular, a lateral relative movement of the entrainer element relative to the actuating element is effectively prevented.

A support device may, for example, be configured as a stop stabiliser.

The support device preferably comprises at least one support element.

A support element may, for example, be configured as a support element, which is, for example, cylindrical or cuboidal and provides support substantially at points.

Furthermore, it may be provided that a support element is configured as a support element which provides support substantially linearly.

Furthermore, it may be advantageous if at least one support element is configured as a support element, which provides support substantially in a planar manner.

A support element may, for example, be arranged on at least one receiving element, on at least one guide rail, on at least one entrainer element, on at least one actuating element, on the carcass, and/or on the drawer.

It may be provided that at least one support element is formed in one piece with at least one receiving element, at least one entrainer element, at least one actuating element, at least one guide rail, the carcass and/or the drawer.

In one configuration of the invention it is provided that at least one receiving element comprises at least one support element, which is formed in that the receiving element, in the assembled state of the drawer guide, extends up to a carcass wall of a carcass or up to a drawer wall of a drawer.

The drawer guide according to the invention is suitable, in particular, for use in conjunction with a carcass and/or a drawer.

The present invention therefore also relates to a combination of a drawer guide according to the invention, a carcass and/or a drawer.

Furthermore, the drawer guide according to the invention may have the following described features and/or advantages:

At least one receiving element is preferably formed as an, in particular one-piece or multi-part, injection-moulded component.

The drawer guide according to the invention preferably does not require any additional holders or bores for the arrangement of the at least one functional device on the carcass or the drawer.

In particular, it may be provided that the drawer guide, in particular a carcass-side guide rail of the drawer guide, is configured to be arranged directly on a carcass wall of the carcass. Furthermore, it may be provided that the drawer guide, in particular a drawer-side guide rail of the drawer guide, is configured to be arranged directly on a drawer wall of the drawer.

It may be advantageous if the drawer guide comprises two guide rails. As a result, a particularly compact drawer guide can be produced. A drawer guide, which comprises two guide rails, is a partial extension drawer guide, which allows a drawer arranged on the drawer guide to be partially pulled out of a carcass.

Furthermore, it may be advantageous if the drawer guide comprises at least three guide rails, in other words a drawer-side guide rail, a carcass-side guide rail and a centre rail arranged between the drawer-side guide rail and the carcass-side guide rail. A full extension drawer guide, which allows a drawer arranged on a carcass to be completely pulled out of the carcass, can be realised by means of an at least three-rail drawer guide.

Further features and/or advantages of the invention are the subject of the following description and the graphical view of embodiments.

BRIEF DESCRIPTION OF THE DRAWINGS

The same or functionally equivalent elements are provided with the same reference numerals in all the figures.

DETAILED DESCRIPTION OF THE DRAWINGS

Figure 1:
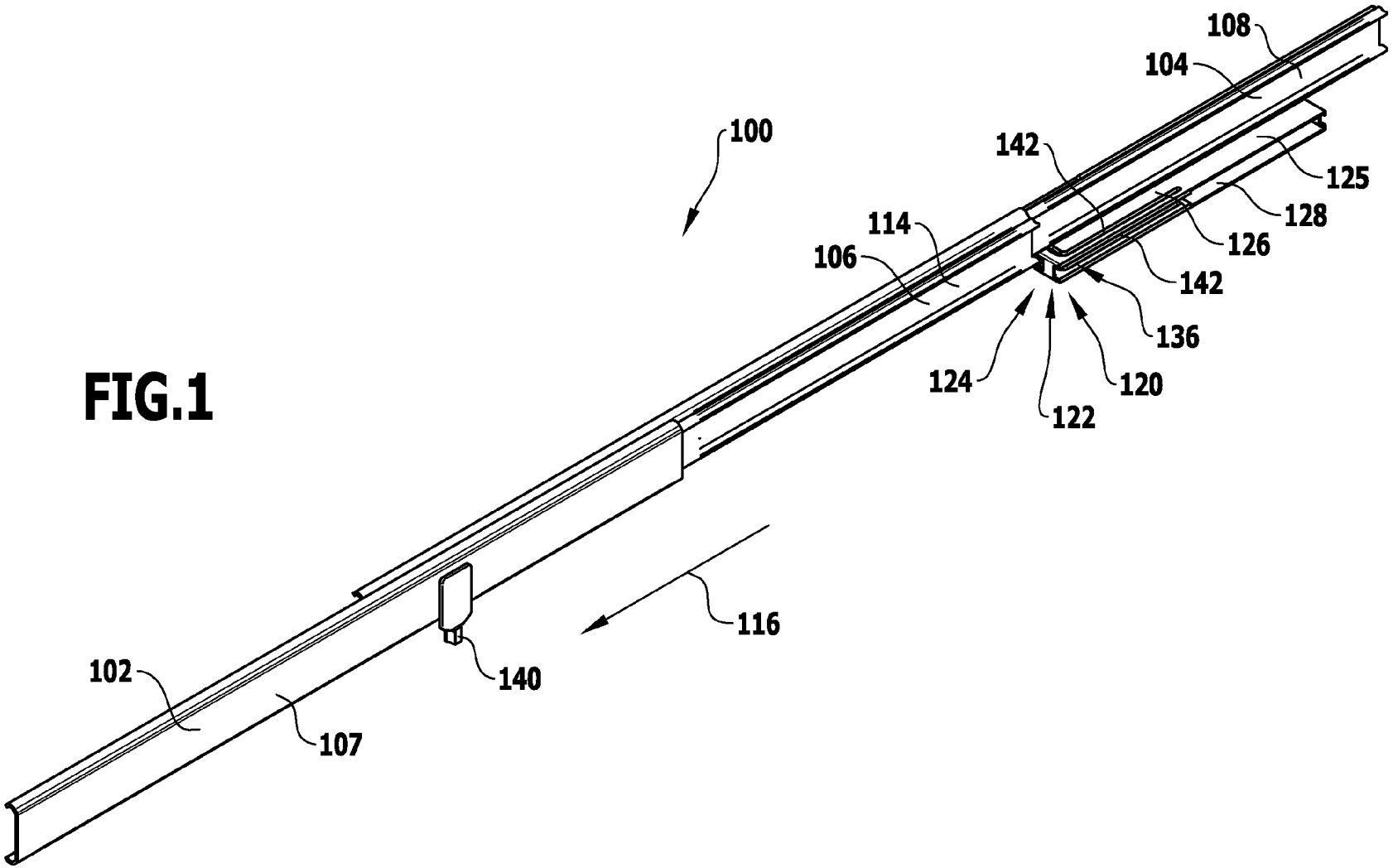
FIG. 1 shows a schematic perspective view of a first embodiment of a drawer guide in a completely pulled-out state, a laterally accessible receiving space of a receiving element being provided to receive a functional device.
Figure 2:
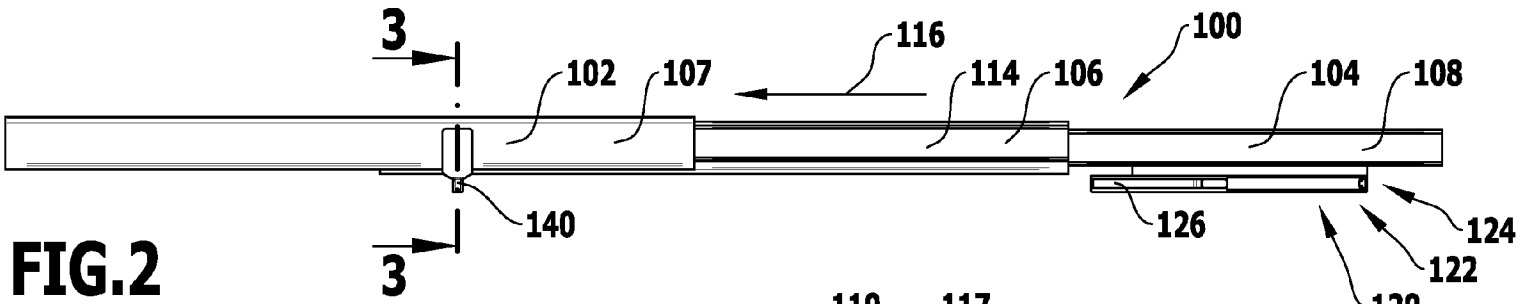
FIG. 2 shows a schematic side view of the drawer guide from FIG. 1 with a view of a side of the drawer guide facing a drawer in the assembled state of the drawer guide.
Figure 3:
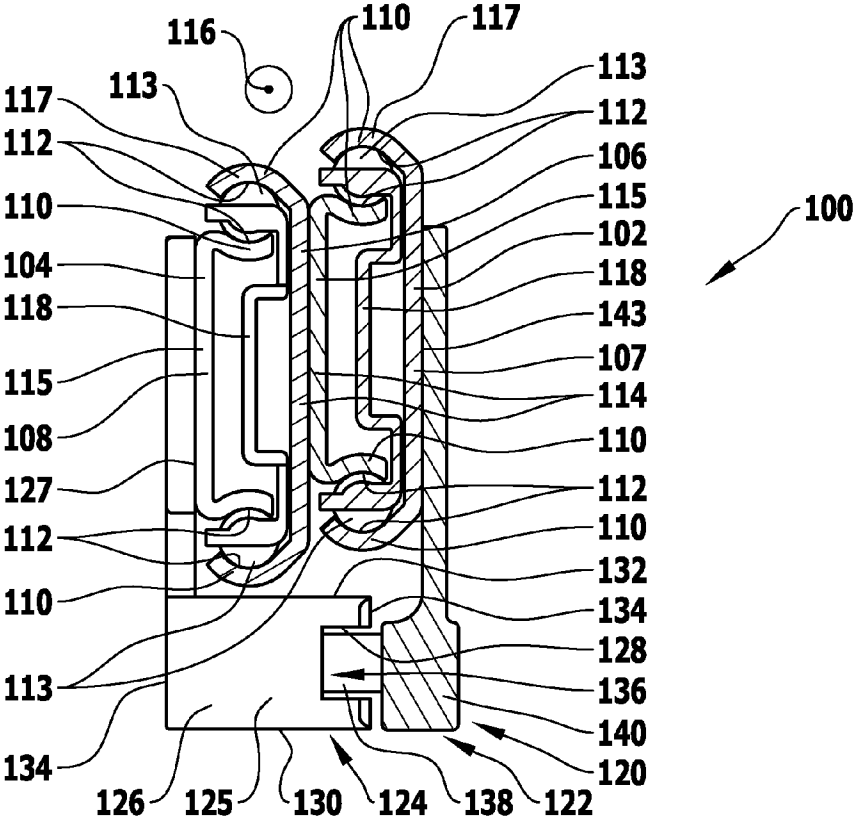
FIG. 3 shows a schematic vertical cross-section through the drawer guide from FIG. 1 along the line 3-3 in FIG. 2.

A first embodiment of a drawer guide designated 100 as a whole and shown in FIGS. 1 to 3 comprises a drawer side guide rail 102 arranged on a drawer (not shown) in an assembled state (not shown) of the drawer guide 100, a carcass-side guide rail 104 arranged on a carcass (not shown) in the assembled state of the drawer guide 100 and a centre rail 106 arranged between the drawer-side guide rail 102 and the carcass-side guide rail 104.

A drawer can be moved relative to a carcass, in particular pulled out of a carcass, by means of the drawer guide 100.

The drawer-side guide rail 102 and the carcass-side guide rail 104 are in each case substantially C-shaped and in each case comprise a rail back, which is substantially vertically oriented in the assembled state of the drawer guide 100, namely a rail back 107 of the drawer-side guide rail 102 and a rail back 108 of the carcass-side guide rail 104.

The rail backs 107, 108 in each case connect two legs 110 of the guide rails 102, 104 to one another, on which rolling element tracks 112 are configured.

The centre rail 106 is formed from two substantially C-shaped rails and as such comprises two rail backs 114, which are connected to one another and from which a total of four legs 110 with rolling element tracks 112 configured thereon project away.

In the assembled state of the drawer guide 100, rolling elements 113 are arranged between the rolling element tracks 112 of the carcass-side guide rail 104 and the rolling element tracks 112 of the centre rail 106 and between the rolling element tracks 112 of the centre rail 106 and the rolling element tracks 112 of the drawer-side guide rail 102, said rolling elements being, for example, substantially spherical and produced from a metallic material, in particular from steel, or from a plastics material.

The legs 110 of the carcass-side guide rail 104 are arranged between the rolling elements 113 guided thereon, so the carcass-side guide rail 104 is a so-called inner rail 115.

The legs 110 of the drawer-side guide rail 102 embrace the rolling elements 113 guided thereon, so the rolling elements 113 are arranged between the legs 110 of the drawer-side guide rail 102. The drawer-side guide rail 102 is consequently an outer rail 117 (see FIG. 3).

The centre rail 106 is composed of an inner rail 115 facing the drawer-side guide rail 102 and an outer rail 117 facing the carcass-side guide rail 104.

By means of the rolling elements 113, the centre rail 106 can be moved relative to the carcass-side guide rail 104 and the drawer-side guide rail 102 can be moved relative to the centre rail 106, so that effectively the drawer-side guide rail 102 is movable by means of the centre rail 106 relative to the carcass-side guide rail 104.

In order to prevent an undesired displacement of the rolling elements 113 along a pull-out direction 116, in which the drawer-side guide rail 102 is movable relative to the carcass-side guide rail 104, the drawer guide 100 comprises two rolling element cages 118, which ensure that the rolling elements 113 are arranged in predetermined positions relative to one another.

As is to be inferred, in particular from FIG. 3, the drawer-guide 100 comprises a functional device 120, which is, for example, configured as a pull-in device 122 with a damping device 124.

By means of the functional device 120, a relative movement of the drawer-side guide rail 102 relative to the carcass-side guide rail 104 can be influenced.

In particular, the pull-in device 122 can ensure that the drawer-side guide rail 102 and therefore also a drawer arranged thereon is brought automatically from an at least partially pulled-out state into the completely inserted state.

The damping device 124 can, in this case, prevent the drawer-side guide rail 102 being abruptly decelerated by a stop in the completely inserted position. Rather, the damping device 124 enables the drawer-side guide rail 102 to be gently pulled into the completely inserted position.

In order to minimise an installation space for the drawer guide 100 together with the functional device 120 in a horizontal direction perpendicular to the pull-out direction 116 as far as possible, so that a space within a carcass can be used as extensively as possible by a drawer that is as large as possible, the functional device 120 in the first embodiment of the drawer guide 100 shown in FIG. 1 is arranged vertically under all the rolling element tracks 112 of the drawer guide 100.

For this purpose, the drawer guide 100 comprises a receiving element 126, which is arranged on the rail back 108 of the carcass-side guide rail 104 and is substantially L-shaped. As a result, the receiving element 126 also comprises a portion 125 of the receiving element 126, which is arranged vertically below the rolling element tracks 112 of the drawer guide 100. This portion 125 has a receiving space 128, in which the functional device 120, in other words the pull-in device 122 and the damping device 124, is arranged.

The receiving space 128 is substantially cuboidal in this case and comprises a lower limiting wall 130, which downwardly limits the receiving space 128 in the assembled state of the drawer guide 100 in the vertical direction.

Furthermore, the receiving element 126 comprises an upper limiting wall 132, which upwardly limits the receiving space 128 in the assembled state of the drawer guide 100 in the vertical direction.

The upper limiting wall 132 and the lower limiting wall 130 in each case comprise a guideway 142, in which an actuating element 138 (still to be described) is displaceably received.

Finally, the receiving element 126 comprises two lateral limiting walls 134, which laterally limit the receiving space 128 in the assembled state of the drawer guide 100 in the horizontal direction and perpendicularly to the pull-out direction 116.

The lateral limiting wall 134 facing the drawer in the assembled state of the drawer guide 100 is provided with an access opening 136 in the first embodiment of the drawer guide 100 shown in FIG. 1.

The access opening 136 of the receiving element 126 extends substantially along the pull-out direction 116.

In the assembled state of the drawer guide 100, at least one actuating element 138 of the functional device 120 extends through the access opening 136 to actuate the functional device 120 (see in particular FIG. 3).

The actuating element 138 of the functional device 120 therefore extends in the direction of the drawer starting from the receiving space 128 in the assembled state of the drawer guide 100.

The drawer guide 100 furthermore comprises an entrainer element 140, which is arranged on the rail back 107 of the drawer-side guide rail 102, in particular on an outer side 143, which faces away from the legs 110 of the drawer-side guide rail 102, of the rail back 106 of the drawer-side guide rail 102 and is configured to be made to engage with the actuating element 138 to actuate the functional device 120.

The entrainer element 140, for this purpose, is also arranged in portions below all the rolling element tracks 112 of the drawer guide 100. In particular, the entrainer element 140 is arranged in such a way that it is arranged next to the access opening 136 of the receiving element 126 with respect to the pull-out direction 116. In this manner, the entrainer element 140 can be particularly easily made to engage with the actuating element 138 projecting out of the access opening 136 of the receiving element 126.

The above-described first embodiment of the drawer guide 100 functions as follows:

In the completely inserted state (not shown) of the drawer guide 100, a drawer is displaceably held by means of the drawer guide 100 on a carcass and arranged completely in the carcass.

A user can now pull the drawer out of the carcass in order to access the contents of the drawer.

The drawer-side guide rail 102 is thereby moved relative to the carcass-side guide rail 104 in the pull-out direction 116.

The entrainer element 140, which is arranged on the drawer-side guide rail 102 and is engaged with the actuating element 138 in the completely inserted state of the drawer guide 100, is moved in the pull-out direction 116 together with the drawer-side guide rail 102. As a result, the actuating element 138 is firstly also moved in the pull-out direction 116. This results in the fact that an energy storage device, which is arranged on the actuating element 138 and is formed, for example, by a spring, stores energy, which is later available to automatically pull in the drawer-side guide rail 102.

In a tensioned state of the spring (not shown) of the functional device 120, in which the drawer guide 100 is partially pulled out, the actuating element 138 is disengaged from the entrainer element 140 and stopped in a storage position. This takes place, for example, by means of a movement of the actuating element 138 transversely to the pull-out direction 116, so the entrainer element 140 no longer engages behind the actuating element 138 and an undesired displacement of the actuating element 138 counter to the pull-out direction 116 is simultaneously prevented.

The movement of the actuating element 138 is predetermined here by means of the guideways 142, which are formed by recesses in the upper limiting wall 132 and in the lower limiting wall 130 of the receiving element 126.

After the disengagement of the entrainer element 140 from the actuating element 138, the drawer guide 100 can be brought into the completely pulled-out state, so a user can particularly easily access the contents of the drawer.

The drawer is inserted in the reverse direction, in other words counter to the pull-out direction 116.

In a partially inserted state, the entrainer element 140 is made to engage with the actuating element 138 again and the latter is released from the stopped storage position, so the energy stored by means of the functional device 120 (spring) can be used to pull in the drawer-side guide rail 102.

The actuating element 138 then pulls the entrainer element 140 and therefore also the drawer-side guide rail 102 and the drawer arranged thereon into the completely inserted position of the drawer guide 100.

In order to prevent an undesired abrupt stopping of the drawer in the completely inserted position of the drawer guide 100, the movement of the drawer-side guide rail 102 relative to the carcass-side guide rail 104 is damped by means of the damping device 124, in other words gently decelerated.

The drawer can therefore be completely inserted into the carcass particularly gently and automatically by means of the functional device 120.

Figure 4:
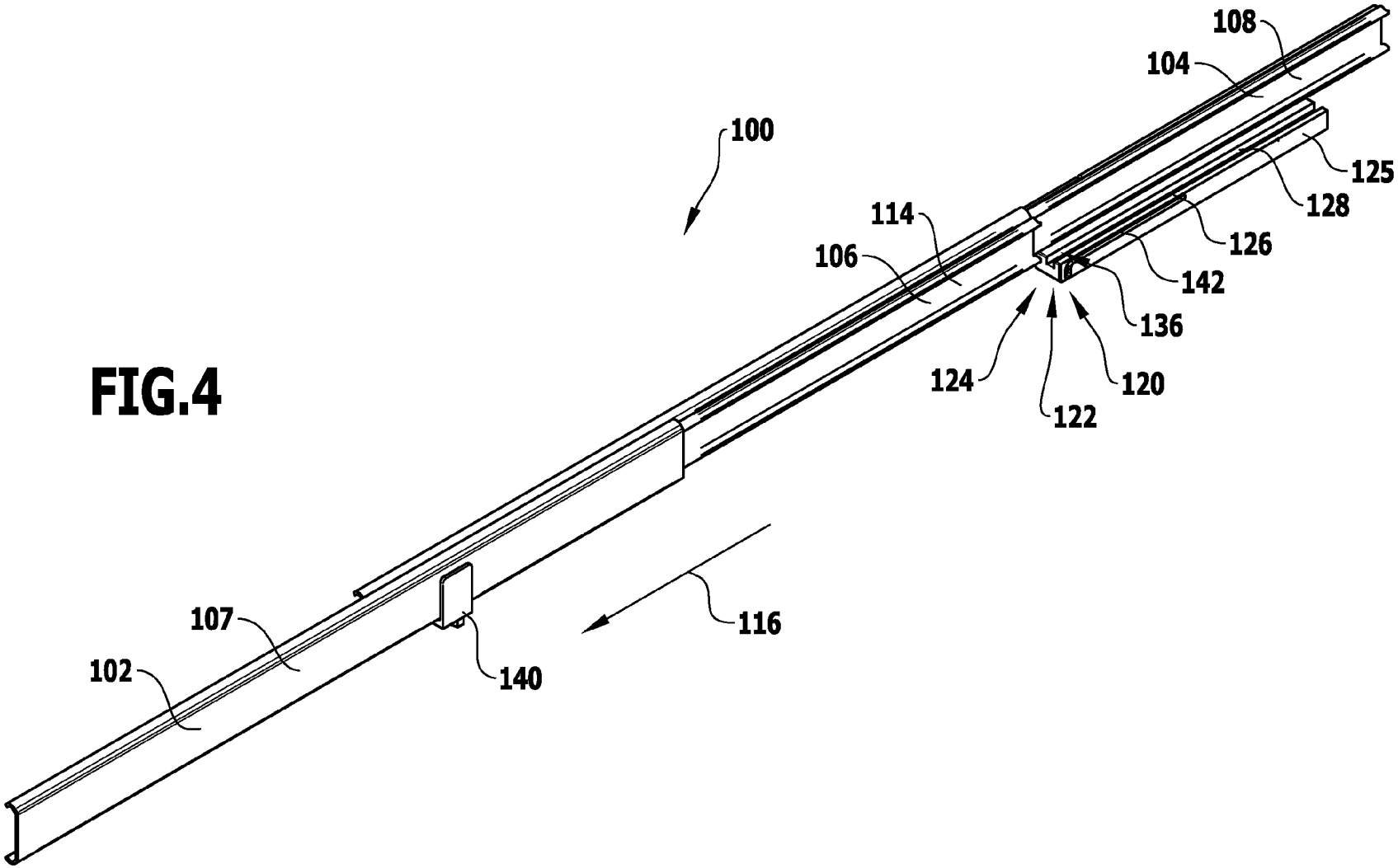
FIG. 4 shows a schematic perspective view, corresponding to FIG. 1, of a second embodiment of a drawer guide in the completely pulled-out state, an upwardly open receiving space of a receiving element being provided.
Figure 5:
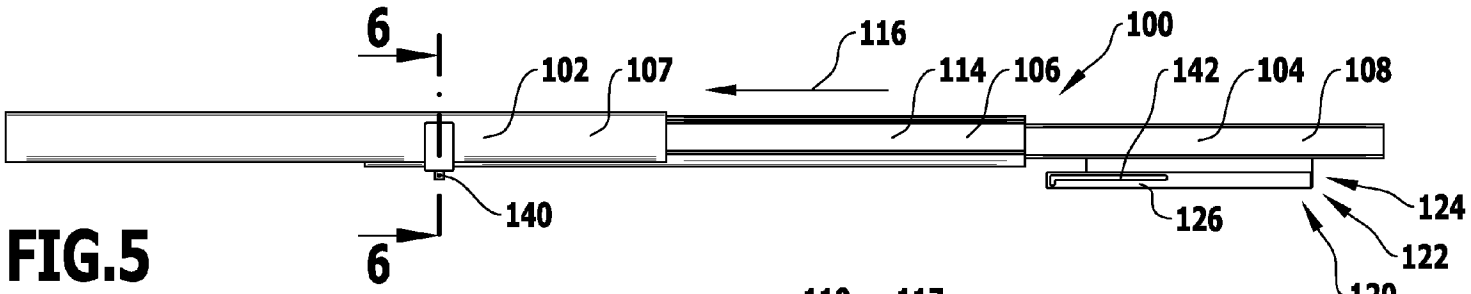
FIG. 5 shows a schematic side view of the drawer guide from FIG. 4 corresponding to FIG. 2.
Figure 6:
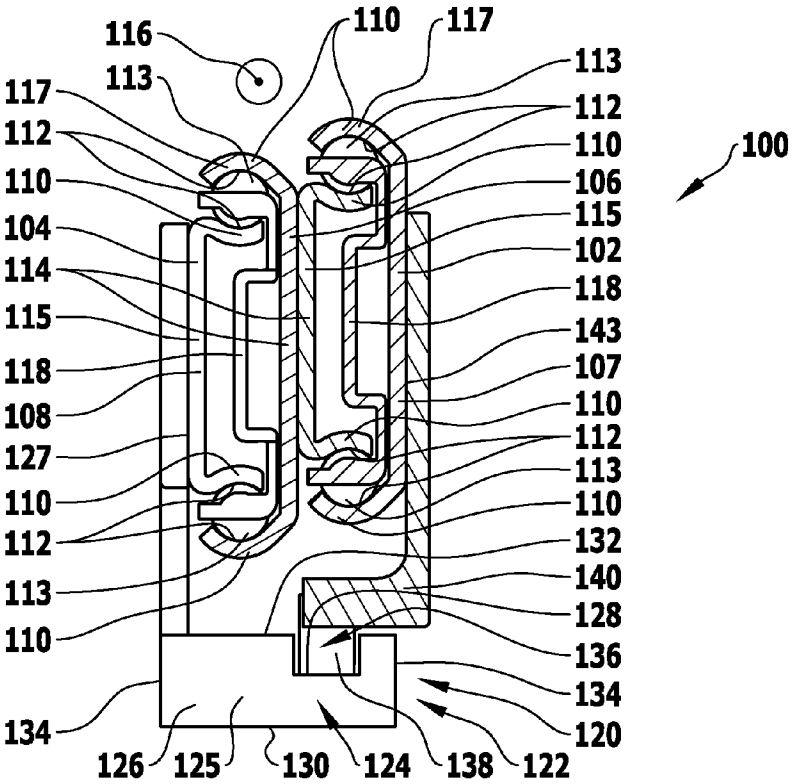
FIG. 6 shows a schematic sectional view, corresponding to FIG. 3, of the drawer guide from FIG. 4.

A second embodiment of a drawer guide 100 shown in FIGS. 4 to 6 differs from the first embodiment shown in FIGS. 1 to 3 substantially in that the receiving element 126 has an upwardly open receiving space 128.

The access opening 136 of the receiving element 126, in the second embodiment shown in FIGS. 4 to 6, is therefore arranged in the upper limiting wall 132 of the receiving element 126. Consequently, the actuating element 138, in the assembled state of the drawer guide 100, projects upwardly out of the receiving space 128.

The entrainer element 140 is correspondingly adapted to the alternative configuration of the receiving element 126 and is, for example, L-shaped, so in the second embodiment of the drawer guide 100 shown in FIGS. 4 to 6, the entrainer element 140 is also arranged directly next to the access opening 136 with respect to the pull-out direction 116, in other words, in this case, directly over the access opening 136.

Otherwise, the second embodiment of the drawer guide 100 shown in FIGS. 4 to 6, coincides with respect to structure and function with the first embodiment shown in FIGS. 1 to 3, so to this extent reference is made to the above description thereof.

Figure 7:
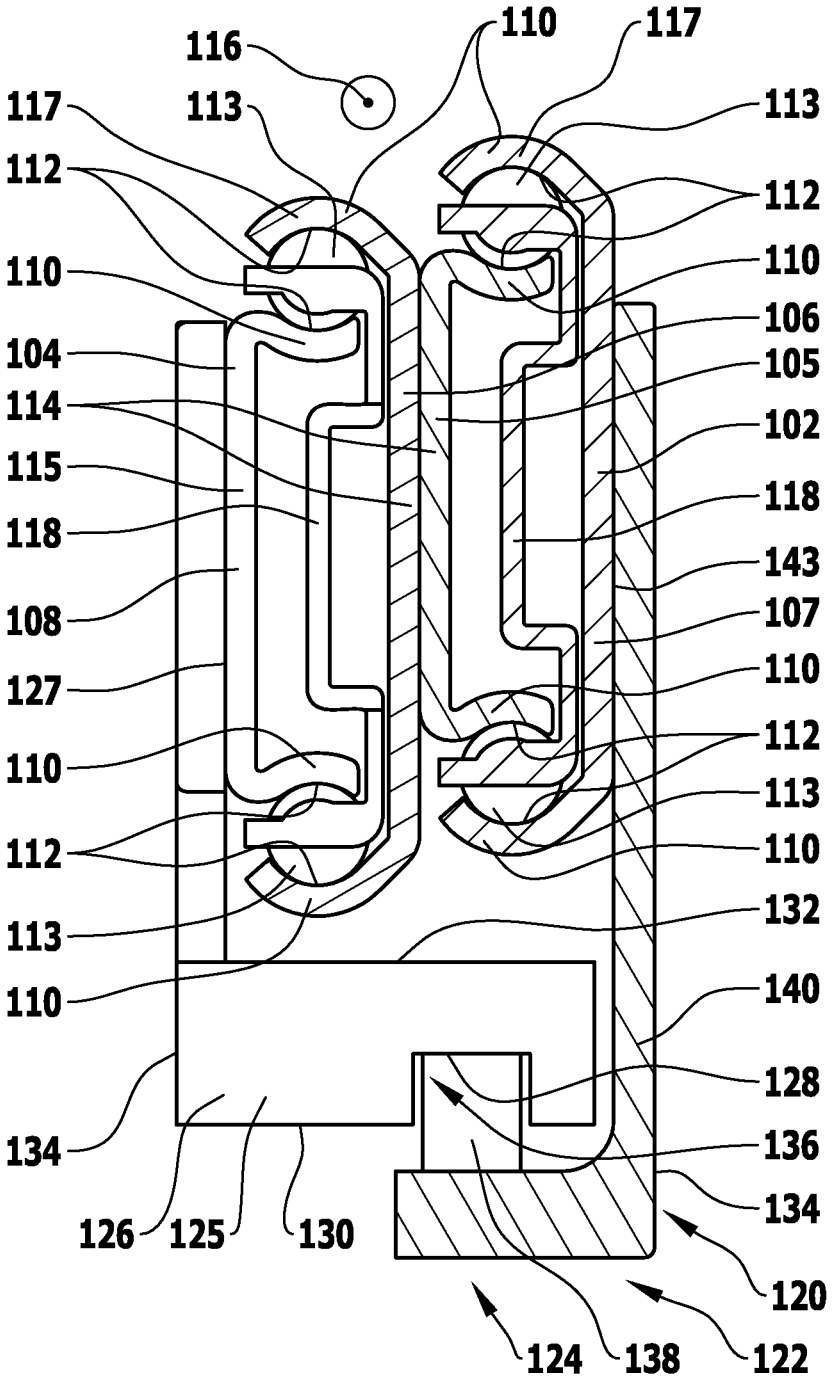
FIG. 7 shows a schematic sectional view, corresponding to FIG. 6, of a third embodiment of a drawer guide, a downwardly open receiving space of a receiving element being provided.

A third embodiment of a drawer-guide 100 shown in FIG. 7 differs from the second embodiment shown in FIGS. 4 to 6 substantially in that the access opening 136 of the receiving element 126 in the third embodiment shown in FIG. 7 is arranged in the lower limiting wall 130 of the receiving element 126 and therefore the actuating element 138 projects downwardly out of the receiving space 128 in the assembled state of the drawer guide 100.

The entrainer element 140 is correspondingly adapted to this configuration of the receiving element 126 and, for this purpose, embraces the receiving element 126 substantially in an L-shape, in order to be made to engage with the actuating element 138 below the receiving element 126.

Otherwise, the third embodiment of the drawer guide 100 shown in FIG. 7 coincides with respect to structure and function with the second embodiment shown in FIGS. 4 to 6, so to this extent reference is made to the above description thereof.

Figure 8:
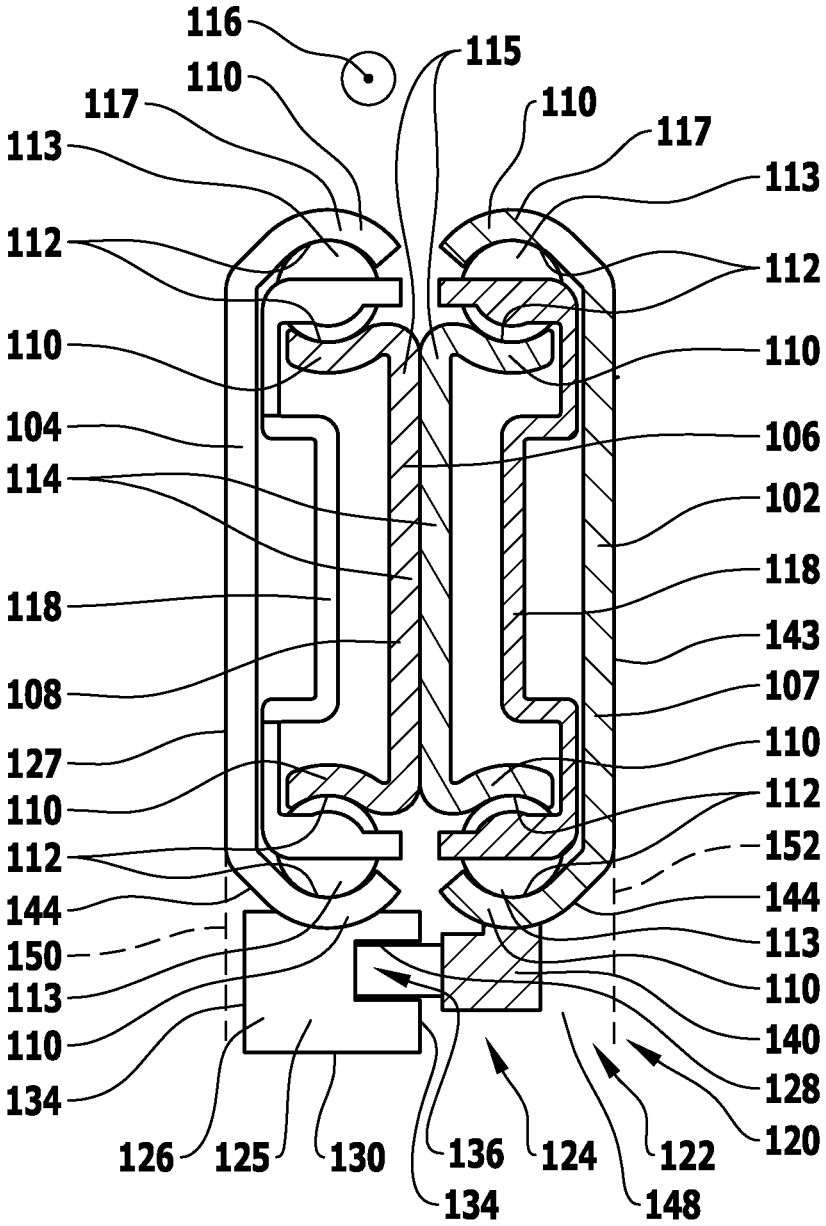
FIG. 8 shows a schematic sectional view, corresponding to FIG. 3, of a fourth embodiment of a drawer guide, the carcass-side guide rail and the drawer-side guide rail being configured as outer rails.

A fourth embodiment of a drawer guide 100 shown in FIG. 8 differs from the first embodiment shown in FIGS. 1 to 3 substantially in that the carcass-side guide rail 104, like the drawer-side guide rail 102, is configured as an outer rail 117.

The centre rail 106 is therefore composed of two inner rails 115.

Furthermore, in the fourth embodiment of the drawer guide 100 shown in FIG. 8, it is provided that the receiving element 126 and the entrainer element 140 are arranged on the outer sides 144, which face away from the rolling elements 113, of the legs 110 of the carcass-side guide rail 104 and/or of the drawer-side guide rail 102.

Because of this arrangement of the receiving element 126 and the entrainer element 140, in the fourth embodiment of the drawer guide 100 shown in FIG. 8, substantially all the components of the functional device 120 together with the receiving element 126 to receive the functional device 120 are arranged in a spatial region 148, which is arranged between two vertical limiting planes 150, 152 in the assembled state of the drawer guide 100, which limiting planes run parallel to one another and parallel to the pull-out direction 116, a first limiting plane 150 running through a first point located furthest to the left in the pull-out direction 116, of the carcass-side guide rail 104 of the drawer guide 100 and the second limiting plane 152 running through a second point, which is located furthest to the right in the pull-out direction 116, of the drawer-side guide rail 102 of the drawer guide 100.

These points, in the embodiment shown in FIG. 8, are predetermined by the outer sides 127, 143 of the rail backs 107, 108 of the guide rails 102, 104.

A particularly compact configuration of the drawer-guide 100 is possible owing to this arrangement of the receiving element 126 of the functional device 120 and the entrainer element 140.

Otherwise, the fourth embodiment of the drawer guide 100 shown in FIG. 8 coincides with respect to structure and function with the first embodiment shown in FIGS. 1 to 3, so to this extent reference is made to the above description thereof.

Figure 9:
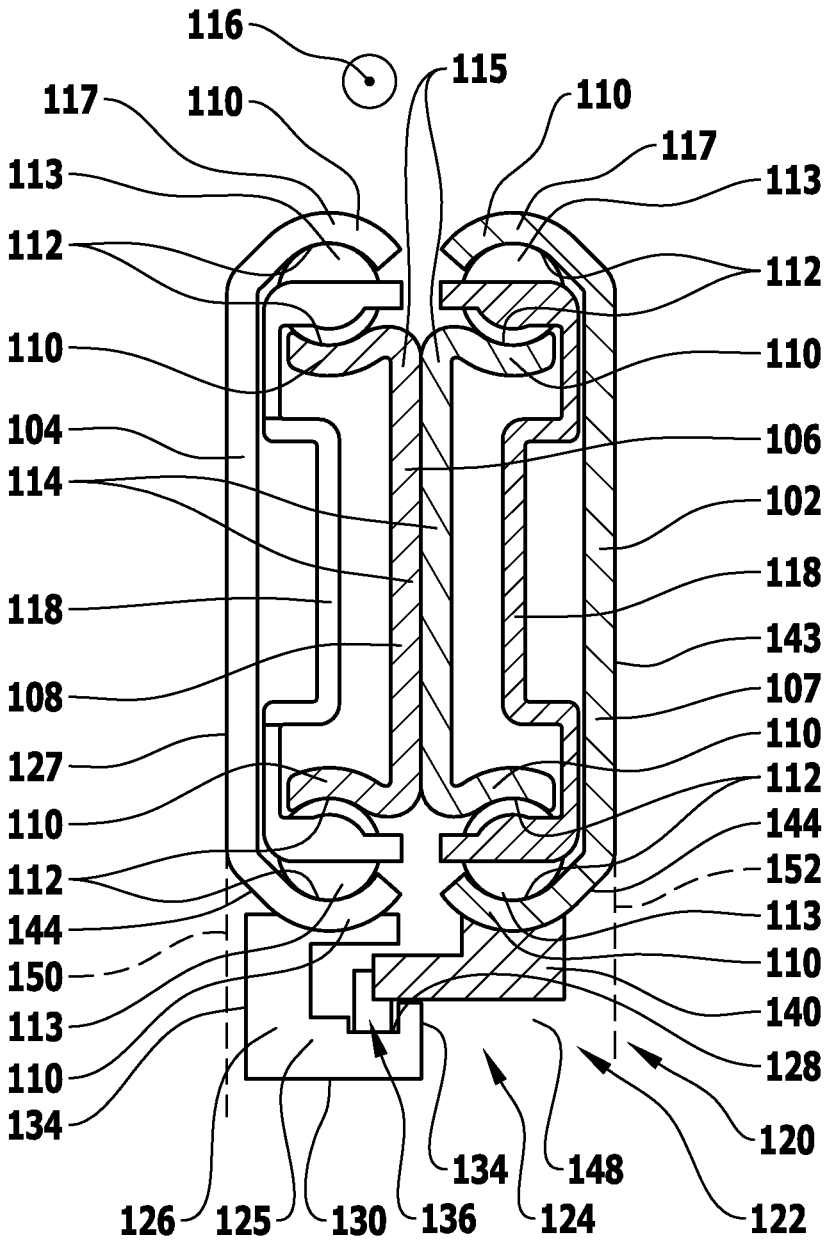
FIG. 9 shows a schematic sectional view, corresponding to FIG. 8, of a fifth embodiment of a drawer guide, an upwardly open receiving space of a receiving element being provided.

A fifth embodiment of a drawer guide 100 shown in FIG. 9 differs from the fourth embodiment shown in FIG. 8 substantially in that the access opening 136 of the receiving element 126 is arranged in an upper limiting wall 132 of the receiving space 128, so the actuating element 138, in the assembled state of the drawer guide 100, projects upwardly out of the receiving space 128.

The entrainer element 140 projects over the receiving element 126 into the region, in which the access opening 136 is arranged, so the entrainer element 140 is configured to be made to engage with the actuating element 138.

Otherwise, the fifth embodiment of the drawer guide 100 shown in FIG. 9 coincides with respect to structure and function with the fourth embodiment shown in FIG. 8, so to this extent reference is made to the above description thereof.

Figure 10:
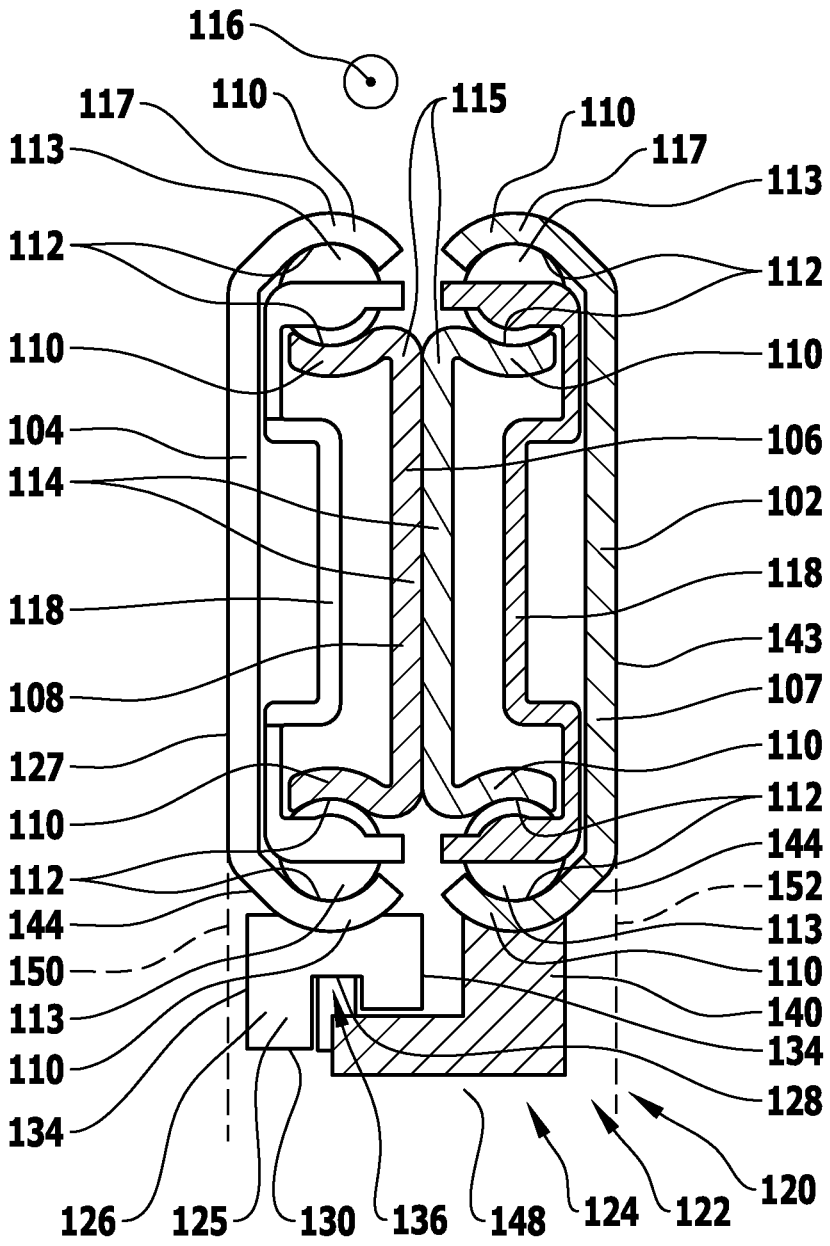
FIG. 10 shows a schematic sectional view, corresponding to FIG. 8, of a sixth embodiment of a drawer guide, a downwardly open receiving space of a receiving element being provided.

A sixth embodiment of a drawer guide 100 shown in FIG. 10 differs from the fifth embodiment shown in FIG. 9 substantially in that the access opening 136 of the receiving element 126 is arranged in a lower limiting wall 130 of the receiving element 126, so the actuating element 138, in the assembled state of the drawer guide 100, projects downwardly out of the receiving space 128.

The entrainer element 140 is correspondingly adapted to this configuration of the receiving element 126 and thus projects into the region below the access opening 136, so the entrainer element 140 is configured to be made to engage with the actuating element 138.

Otherwise, the sixth embodiment of the drawer guide 100 shown in FIG. 10 coincides with respect to structure and function with the fifth embodiment shown in FIG. 9, so to this extent reference is made to the above description thereof.

FIGS. 11 to 20 show further embodiments of the drawer guide 100, which substantially correspond to the above-described embodiments 1 to 6 shown in FIGS. 1 to 10 and substantially differ by the arrangement and orientation of the guide rails 102, 104 and 106 of the receiving element 126 and of the entrainer element 140 from the above-described embodiments.

Figure 11:
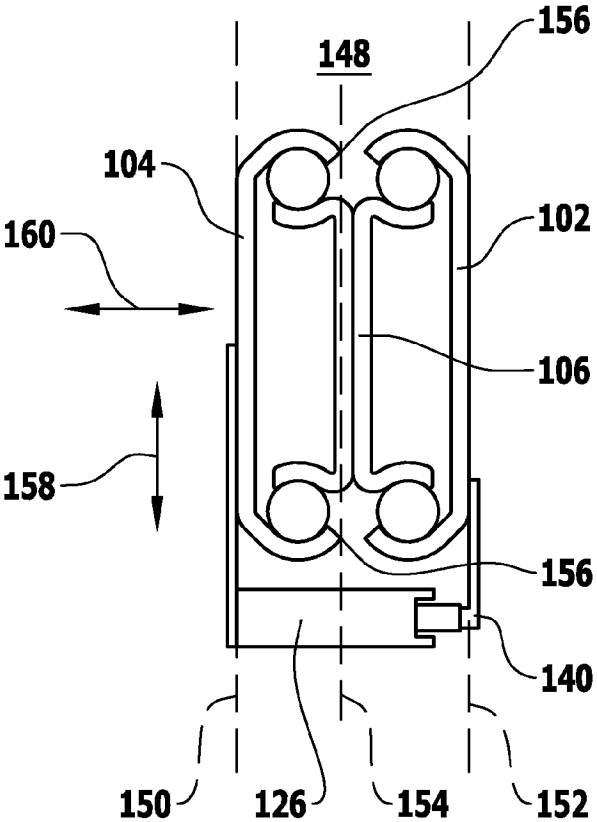
FIG. 11 shows a schematic sectional view of a seventh embodiment of a drawer guide, with vertically oriented rail backs and a horizontally oriented receiving element.

It is thus provided, for example, in the seventh embodiment shown in FIG. 11 that the rail backs 107, 108 of the drawer-side guide rail 102 and/or of the carcass-side guide rail 104 are substantially vertically oriented and predetermine the limiting planes 150, 152 for the definition of the spatial region 148. The limiting planes 150, 152 are therefore oriented substantially vertically and parallel to the pull-out direction 116 in the seventh embodiment of the drawer guide 100 shown in FIG. 11.

The receiving element 126 is at least partially arranged between the limiting planes 150, 152 in this embodiment.

Likewise, the entrainer element 140 in the seventh embodiment of the drawer guide 100 shown in FIG. 11 is at least partially arranged between the limiting planes 150, 152.

Figure 12:
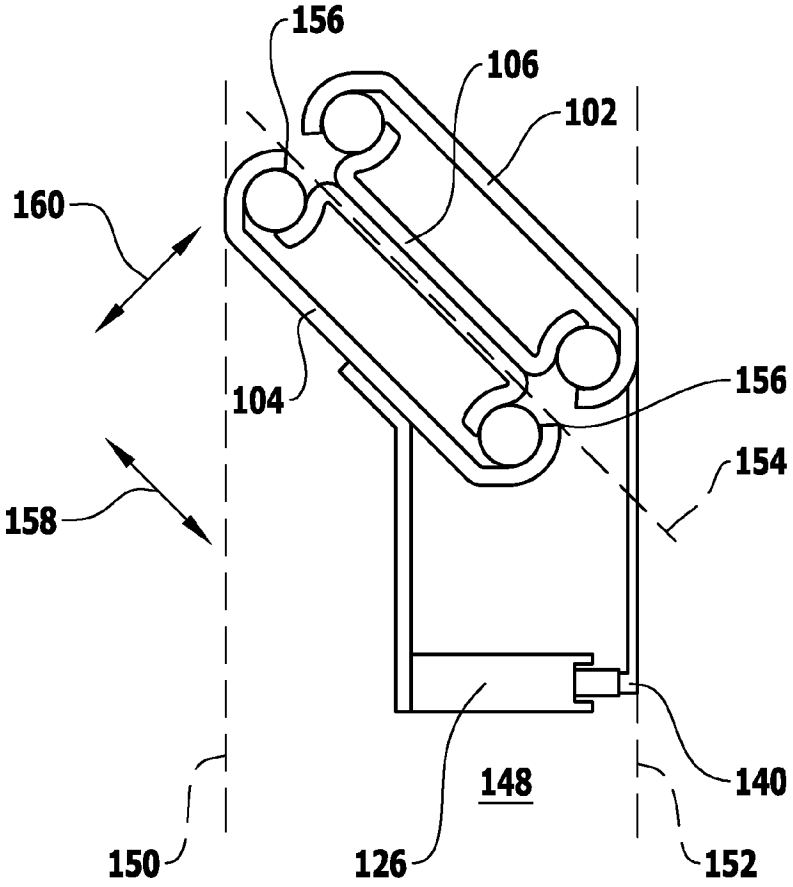
FIG. 12 shows a schematic sectional view of an eighth embodiment of a drawer guide, with rail backs oriented obliquely with respect to the vertical and a horizontal arrangement of a receiving element.

In the eighth embodiment of the drawer guide 100 shown in FIG. 12, the rail backs 107, 108 of the guide rails 102, 104 are oriented obliquely with respect to the vertical, so the limiting planes 150, 152, which are vertically oriented, are predetermined by the outer sides 144 of the legs 110 of the carcass-side guide rail 104 and/or the drawer-side guide rail 102.

In the eighth embodiment of the drawer guide 100 shown in FIG. 12, the receiving element 126 is arranged substantially completely between the limiting planes 150, 152.

Figure 13:
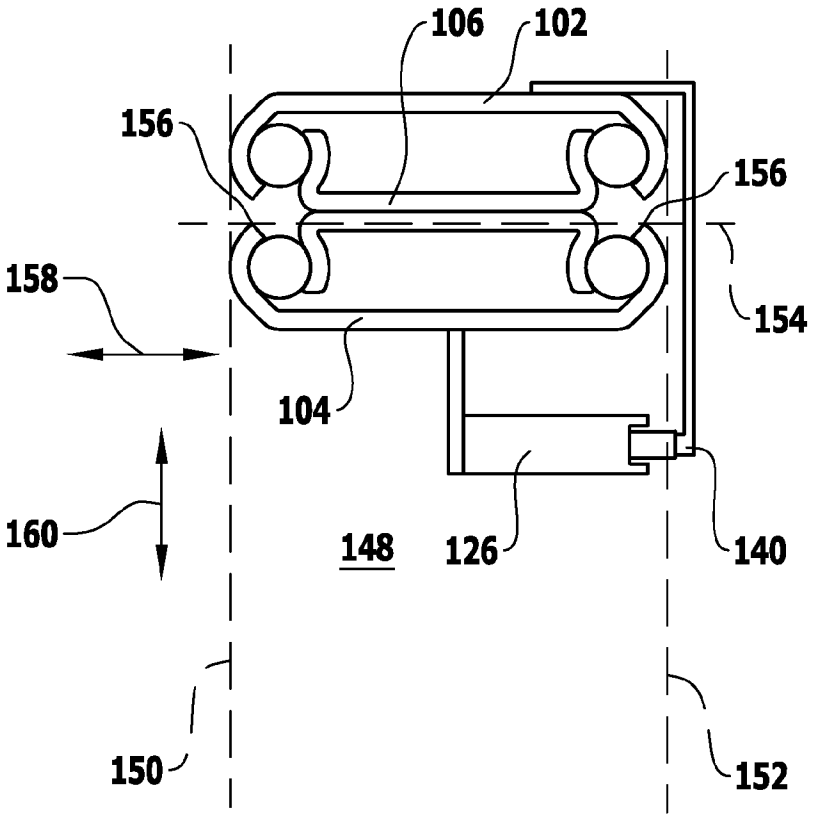
FIG. 13 shows a schematic sectional view of a ninth embodiment of a drawer guide, with horizontally oriented rail backs and a horizontal arrangement of a receiving element.

In the ninth embodiment of a drawer guide 100 shown in FIG. 13, the rail backs 107, 108 of the guide rails 102, 104 are oriented substantially horizontally, so the vertical limiting planes 150, 152 are predetermined by the outer sides 144 of the legs 110 of the guide rails 102, 104.

Figure 14:
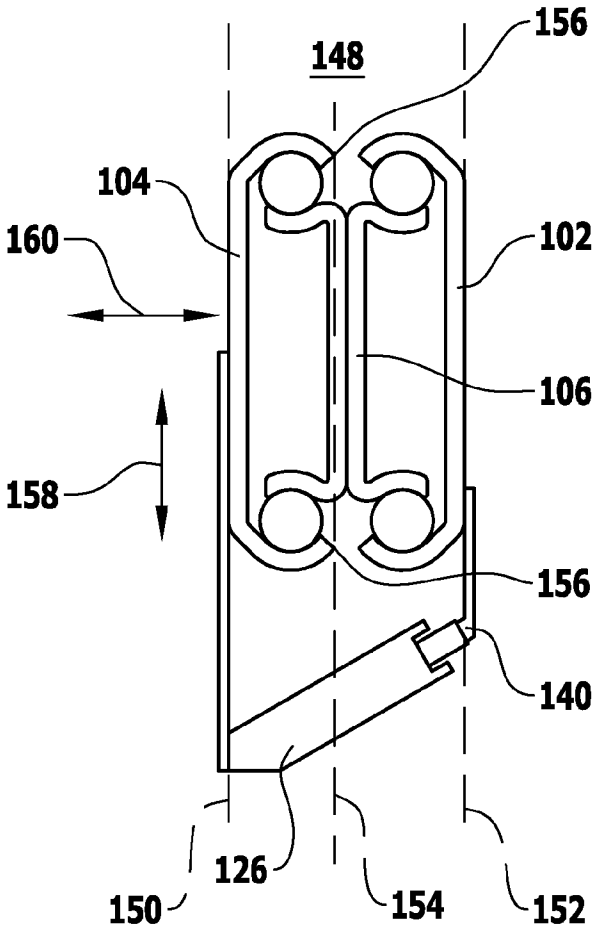
FIG. 14 shows a schematic sectional view of a tenth embodiment of a drawer guide, with vertically oriented rail backs and a receiving element oriented obliquely with respect to the vertical.

The tenth embodiment of the drawer guide 100 shown in FIG. 14 differs from the seventh embodiment shown in FIG. 11 substantially only by the oblique arrangement of the receiving element 126. In this embodiment, the access opening 136 of the receiving element 126 is arranged in an oblique limiting wall of the receiving element 126 and is therefore oriented neither vertically nor horizontally.

The actuating element 138, in the assembled state of the drawer guide 100 in the tenth embodiment of the drawer guide 100 shown in FIG. 14, consequently projects obliquely from the receiving space 128 of the receiving element 126 with respect to the vertical direction and the horizontal direction.

Figure 15:
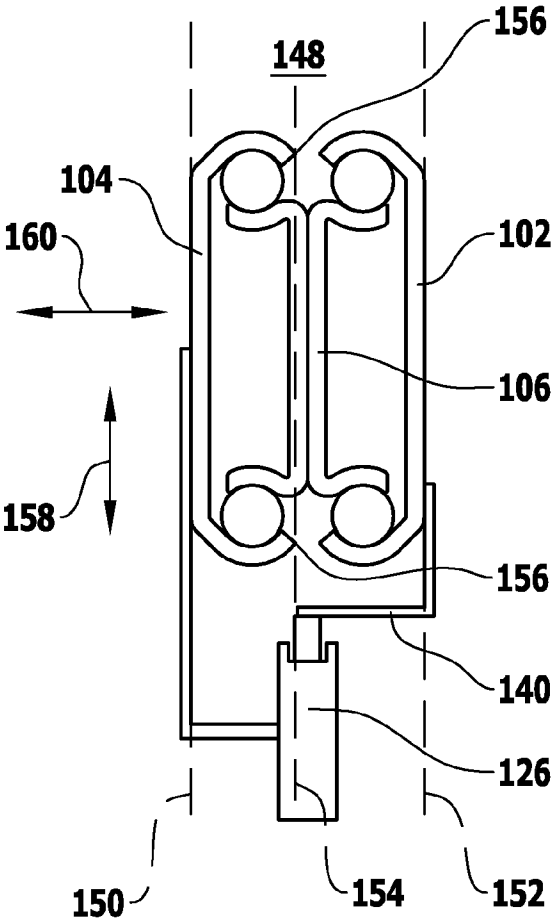
FIG. 15 shows a schematic sectional view of an eleventh embodiment of a drawer guide, with vertically oriented rail backs and a vertically oriented receiving element.

The eleventh embodiment of the drawer guide 100 shown in FIG. 15 differs from the seventh embodiment shown in FIG. 11 substantially in that the receiving element 126 is not arranged horizontally, but vertically, in other words, the actuating element 138 does not project laterally, but upwardly, out of the receiving space 128 (see, likewise, the second embodiment shown in FIGS. 4 to 6).

Figure 16:
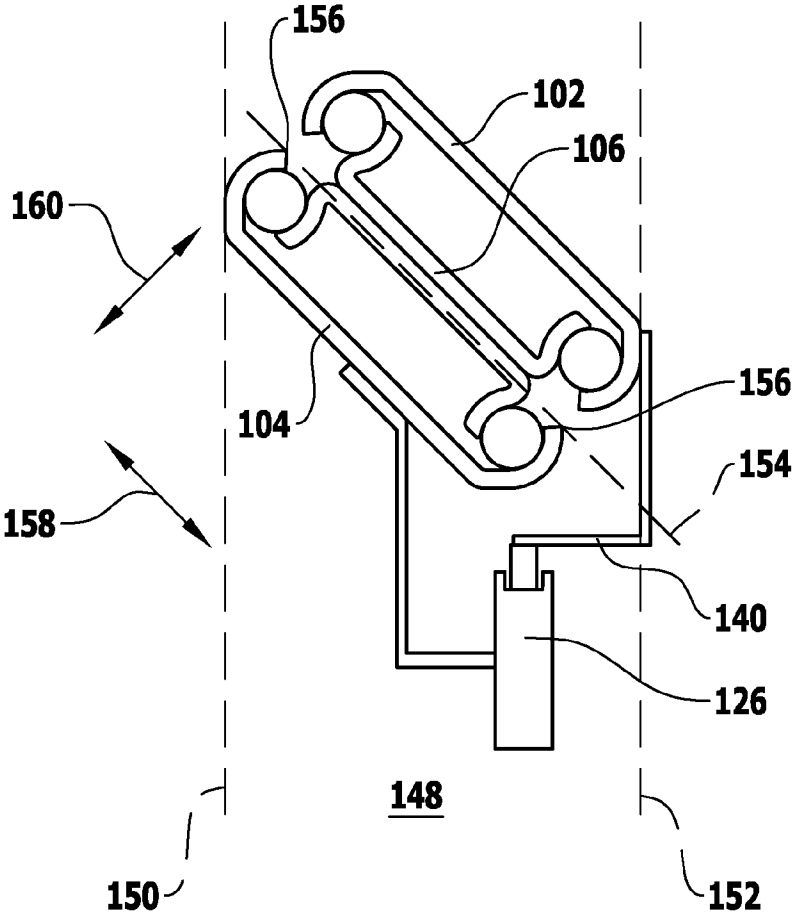
FIG. 16 shows a schematic sectional view of a twelfth embodiment of a drawer guide, with rail backs oriented obliquely with respect to the vertical and a vertically oriented receiving element.

The twelfth embodiment of the drawer guide 100 shown in FIG. 16 corresponds with respect to the arrangement of the guide rails 102, 104, 106 to the eighth embodiment shown in FIG. 12 and substantially corresponds to the eleventh embodiment shown in FIG. 15 with respect to the receiving element 126 and the entrainer element 140. In the twelfth embodiment shown in FIG. 16, an oblique arrangement of the rail backs 107, 108, 114 of the guide rails 102, 104, 106 and an upright arrangement (vertical arrangement) of the receiving element (126) are therefore provided.

Figure 17:
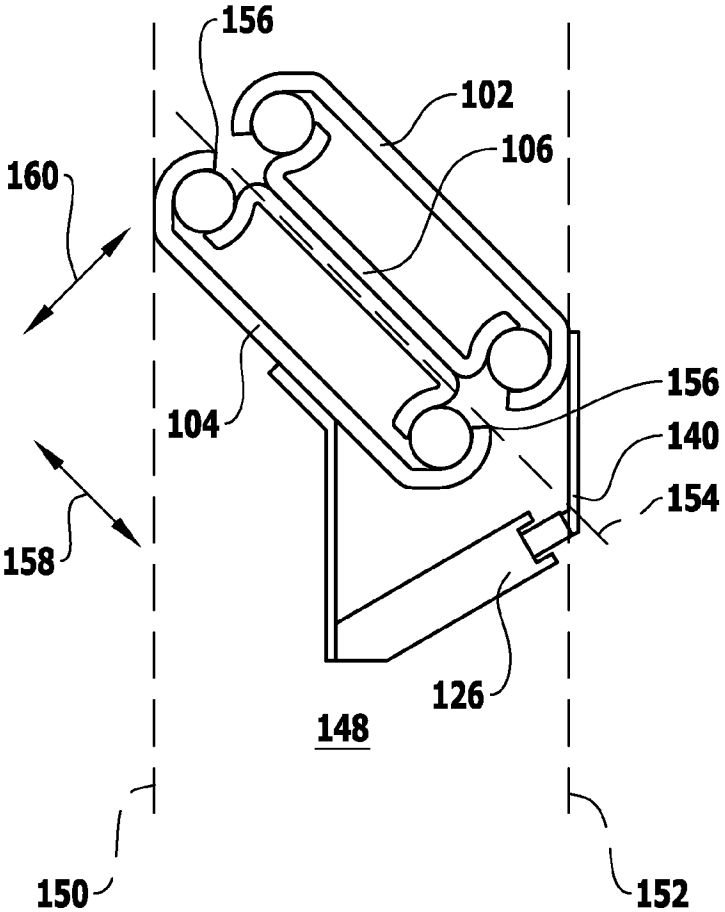
FIG. 17 shows a schematic sectional view of a thirteenth embodiment of a drawer guide, with rail backs arranged obliquely with respect to the vertical and a receiving element arranged obliquely with respect to the vertical.

The thirteenth embodiment of the drawer guide 100 shown in FIG. 17 is a combination of the embodiments shown in FIGS. 12 and 14, wherein, according to the eighth embodiment shown in FIG. 12, an oblique arrangement of the rail backs 107, 108, 114 of the guide rails 102, 104, 106 is provided and, according to the tenth embodiment shown in FIG. 14, an oblique arrangement of the receiving element 126 is provided.

Figure 18:
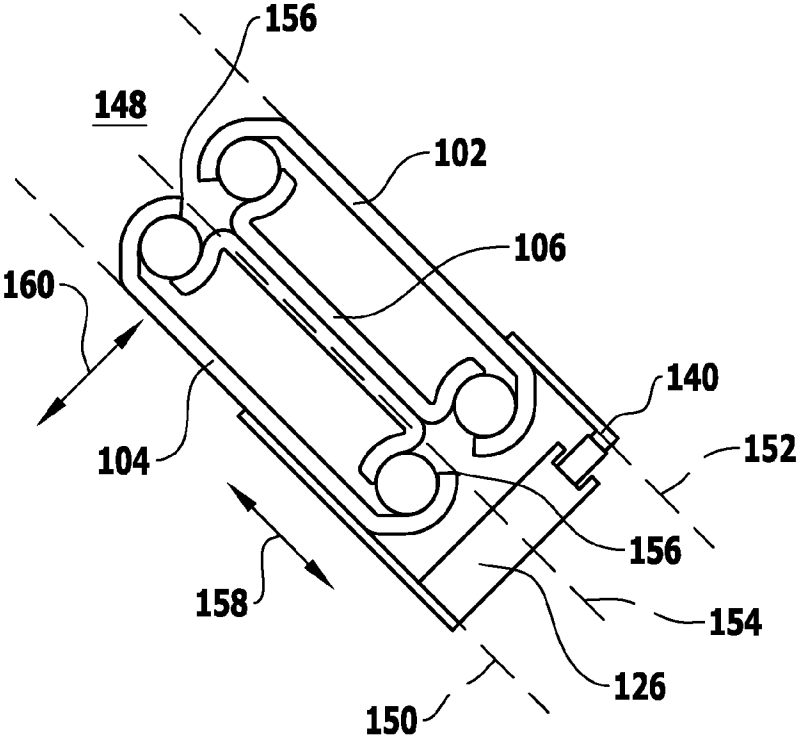
FIG. 18 shows a schematic sectional view of a fourteenth embodiment of a drawer guide, with rail backs oriented parallel to a longitudinal plane and a receiving element oriented perpendicularly thereto.

The fourteenth embodiment of the drawer guide 100 shown in FIG. 18 is an embodiment of a drawer guide 100 substantially corresponding to the seventh embodiment shown in FIG. 11, the entire drawer guide 100 being rotated, for example, by about 45° about the pull-out direction 116.

The limiting planes 150, 152 in the fourteenth embodiment shown in FIG. 18 are not vertical limiting planes 150, 152, but limiting planes predetermined by a longitudinal plane 154 and running parallel thereto.

The longitudinal plane 154 is thus parallel to the pull-out direction 116 and runs through free edges 156 of two legs 110 of a guide rail, for example of the carcass-side guide rail 104.

Because of the rotated arrangement of the guide rails 102, 104, 106, the longitudinal plane 154 is also inclined relative to the vertical direction in the fourteenth embodiment shown in FIG. 18.

Figure 19:
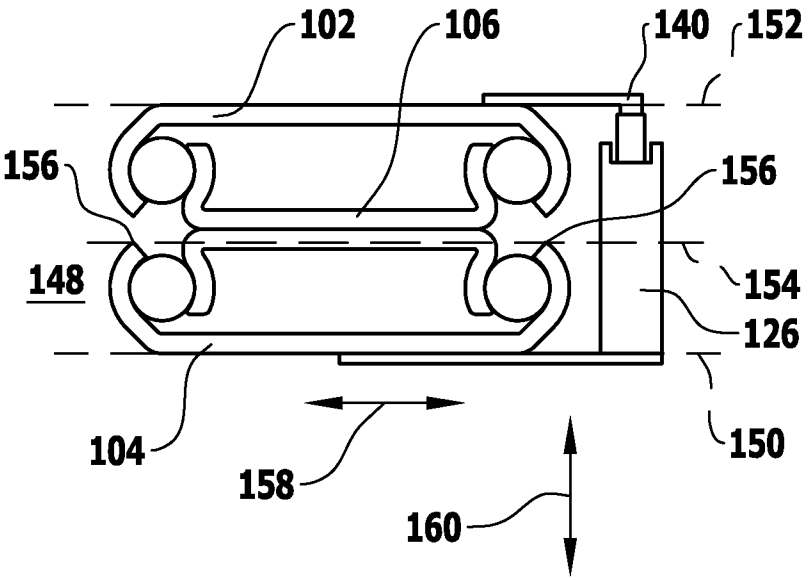
FIG. 19 shows a schematic sectional view of a fifteenth embodiment of a drawer guide, with horizontally oriented rail backs and a vertically oriented receiving element.

FIG. 19 shows a fifteenth embodiment of a drawer guide 100, in which a rotation of the entire drawer guide 100 about the pull-out direction 116 relative to the seventh embodiment shown in FIG. 11 through 90° has taken place, so the longitudinal plane 154 is oriented substantially horizontally.

The relevant spatial region 148, in which the receiving element 126 and/or the entrainer element 140 are preferably at least partially arranged, is consequently predetermined in the fifteenth embodiment shown in FIG. 19 by two horizontal limiting planes 150, 152.

Figure 20:
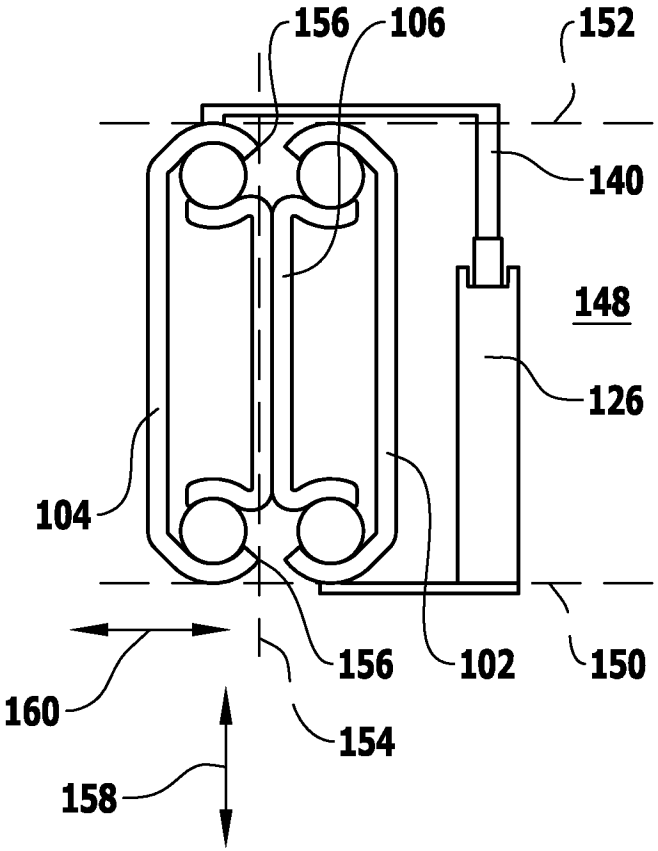
FIG. 20 shows a schematic sectional view of a sixteenth embodiment of a drawer guide, with vertically oriented rail backs and a vertically oriented receiving element.

FIG. 20 shows a sixteenth embodiment of a drawer guide 100, in which horizontal limiting planes 150, 152 are provided to limit the spatial region 148. In the embodiment of the drawer guide 100 shown in FIG. 20 it is, however, provided that the rail backs 107, 108, 114 of the guide rails 102, 104, 106 are oriented substantially vertically. The limiting planes 150, 152 for limiting the spatial region 148, in the sixteenth embodiment shown in FIG. 20 are not governed by the longitudinal plane 154 nor by a vertical orientation, but from the fact that horizontal planes are placed through the uppermost point, on the one hand, and the lowermost point, on the other hand, of one or two different guide rails 102, 104, 106.

Figure 22:
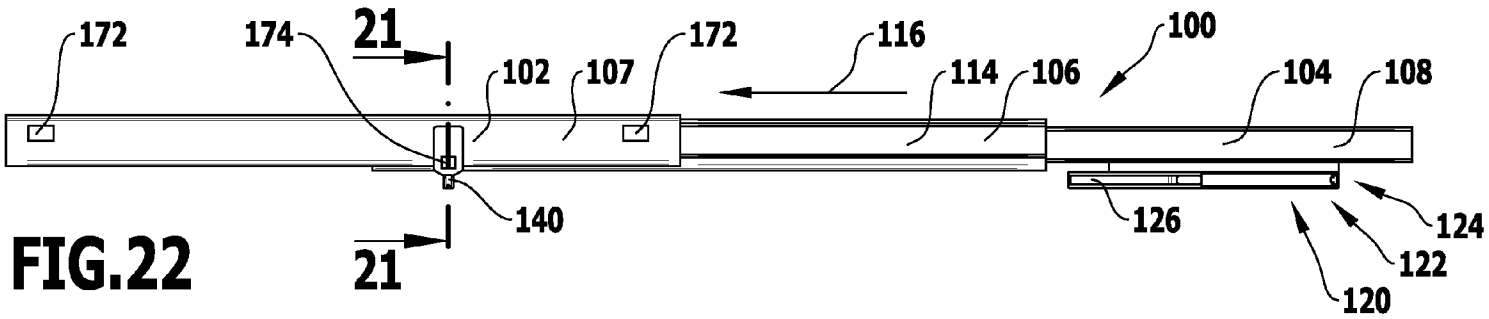
FIG. 22 shows a schematic plan view of a drawer side of the drawer guide from FIG. 21.
Figure 21:
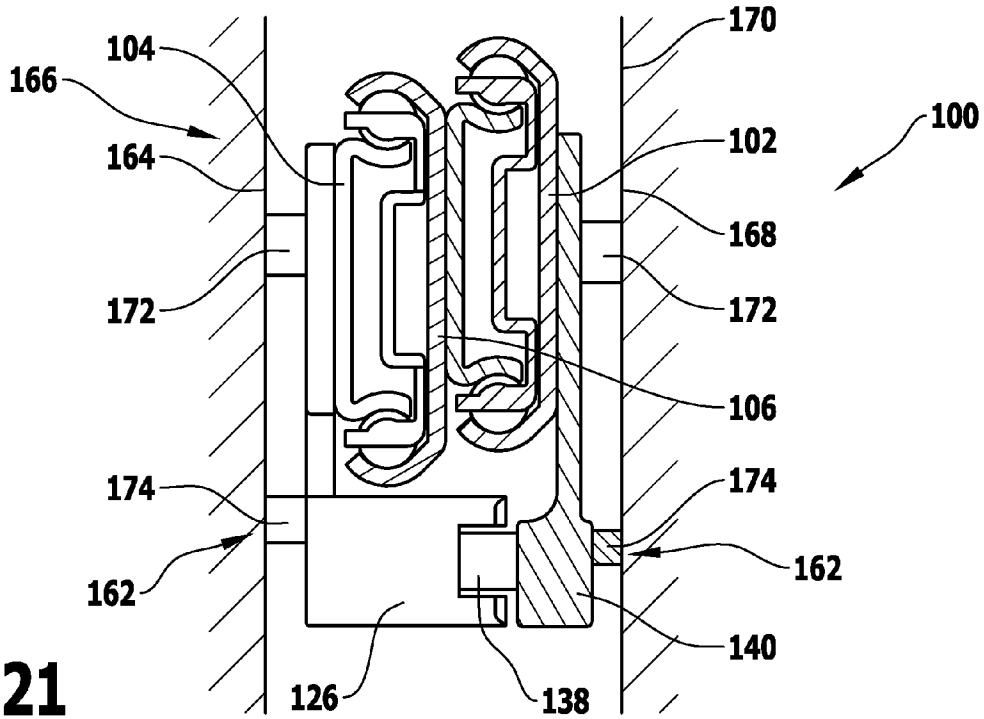
FIG. 21 shows a schematic sectional view, corresponding to FIG. 3, of a seventeenth embodiment of a drawer guide, in which a support device is provided.

A seventeenth embodiment shown in FIGS. 21 and 22 of a drawer guide 100 differs from the first embodiment shown in FIGS. 1 to 3 substantially in that the drawer guide comprises two support devices 162.

As can be gathered, in particular, from FIG. 21, the drawer guide 100 in the seventeenth embodiment shown in FIGS. 21 and 22 is not arranged directly on a carcass wall 164 of a carcass 166 nor directly on a drawer wall 168 of a drawer 170.

Rather, spacer elements 172 are provided to arrange the drawer guide 100 on the carcass wall 164 of the carcass 166 and/or the drawer wall 168 of the drawer 170.

In the assembled state of the drawer guide 100, the receiving element 126, in particular the lower portion 125 of the receiving element 126 and the entrainer element 140, are therefore arranged spaced apart from the carcass wall 164 and/or from the drawer wall 168.

When the drawer 170 moves at high speed and/or with a high load into the completely inserted state, this can lead to a relative movement of the actuating element 138 relative to the entrainer element 140 in a direction perpendicular to the pull-out direction 116, so reliable functioning of the functional device 120 can be impaired.

In order to prevent an evasion movement of this type of the actuating element 138 and/or of the entrainer element 140, a support element 174 is provided, on the one hand, between the lower portion 125 of the receiving element 126 and the carcass wall 164. On the other hand, a support element 174 is provided between the entrainer element 140 and the drawer wall 168.

The support element 174 on the side of the carcass 166 forms a first support device 162 for supporting the drawer guide 100 on the carcass 166. The support element 174 on the side of the drawer 170 forms a second support device 162 for supporting the drawer guide 100 on the drawer 170. Depending on the configuration of the carcass 166, the drawer 170 and/or the drawer guide 100, only one support device 162 can selectively be provided on the side of the carcass 166 or on the side of the drawer 170.

The support elements 174 can prevent the actuating element 138 and the entrainer element 140, when the drawer 170 is inserted at high speed and/or with a high load, from moving relative to one another in an undesired manner and a functioning of the functional device 120 being impaired.

Otherwise, the seventeenth embodiment of a drawer guide 100 shown in FIGS. 21 and 22 coincides with respect to structure and function to the first embodiment shown in FIGS. 1 to 3, so in this respect reference is made to the above description thereof.

Figure 23:
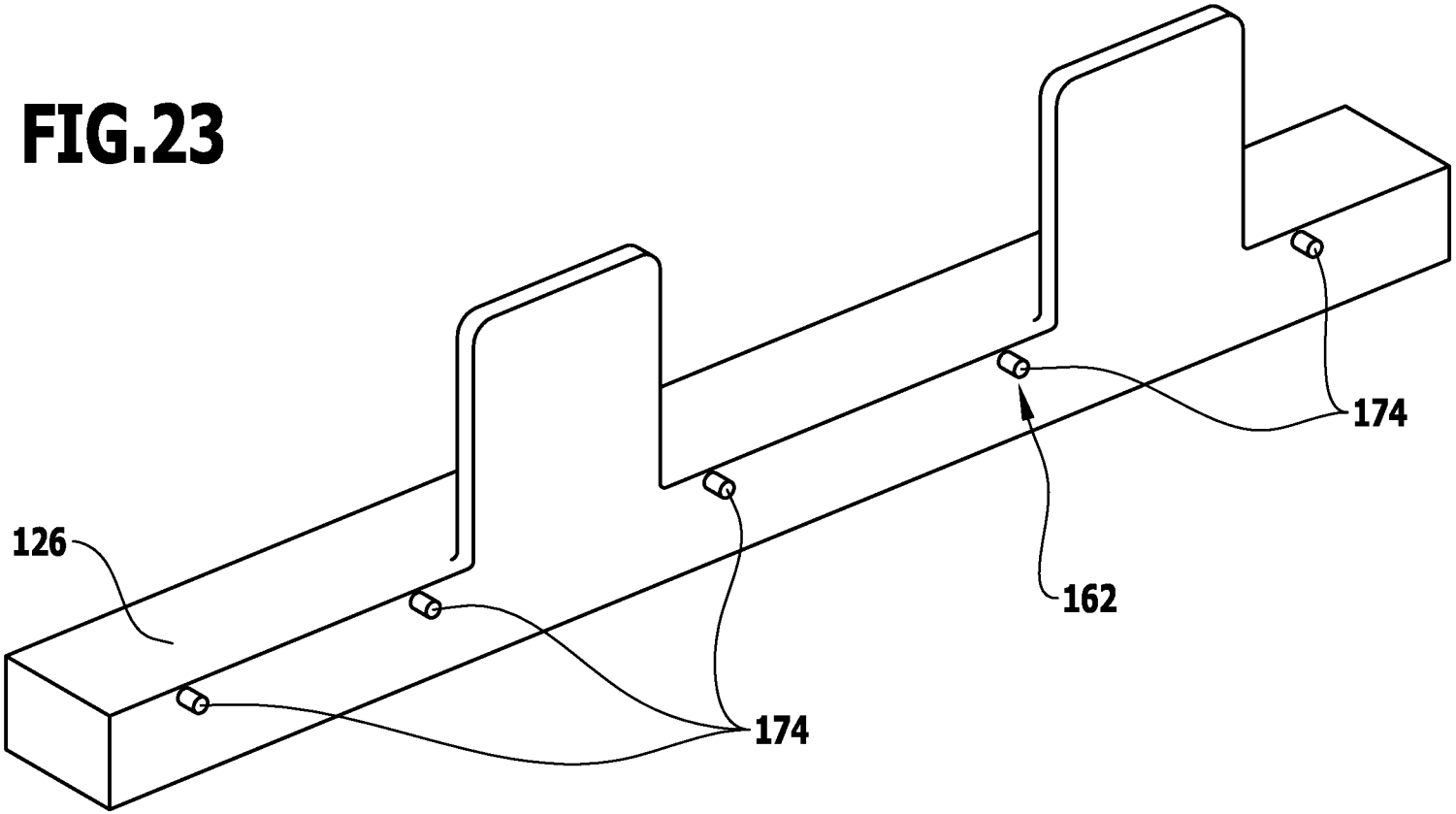
FIG. 23 shows a schematic perspective view of a receiving element, in which support elements, which provide support at points, of a support device are provided.

As can be gathered, in particular, from the view of a receiving element 126 in FIG. 23, it may, for example, be provided that the support device 162 comprises a plurality of support elements 174, which, for example, are support elements 174 substantially providing support at points.

Support elements 174 of this type substantially providing support at points are, for example, substantially cylindrical.

The support elements 174 may, for example, be configured in one piece here with the receiving element 126 and be arranged distributed uniformly thereon. As a result, a reliable support of the receiving element 126 is possible.

Figure 24:
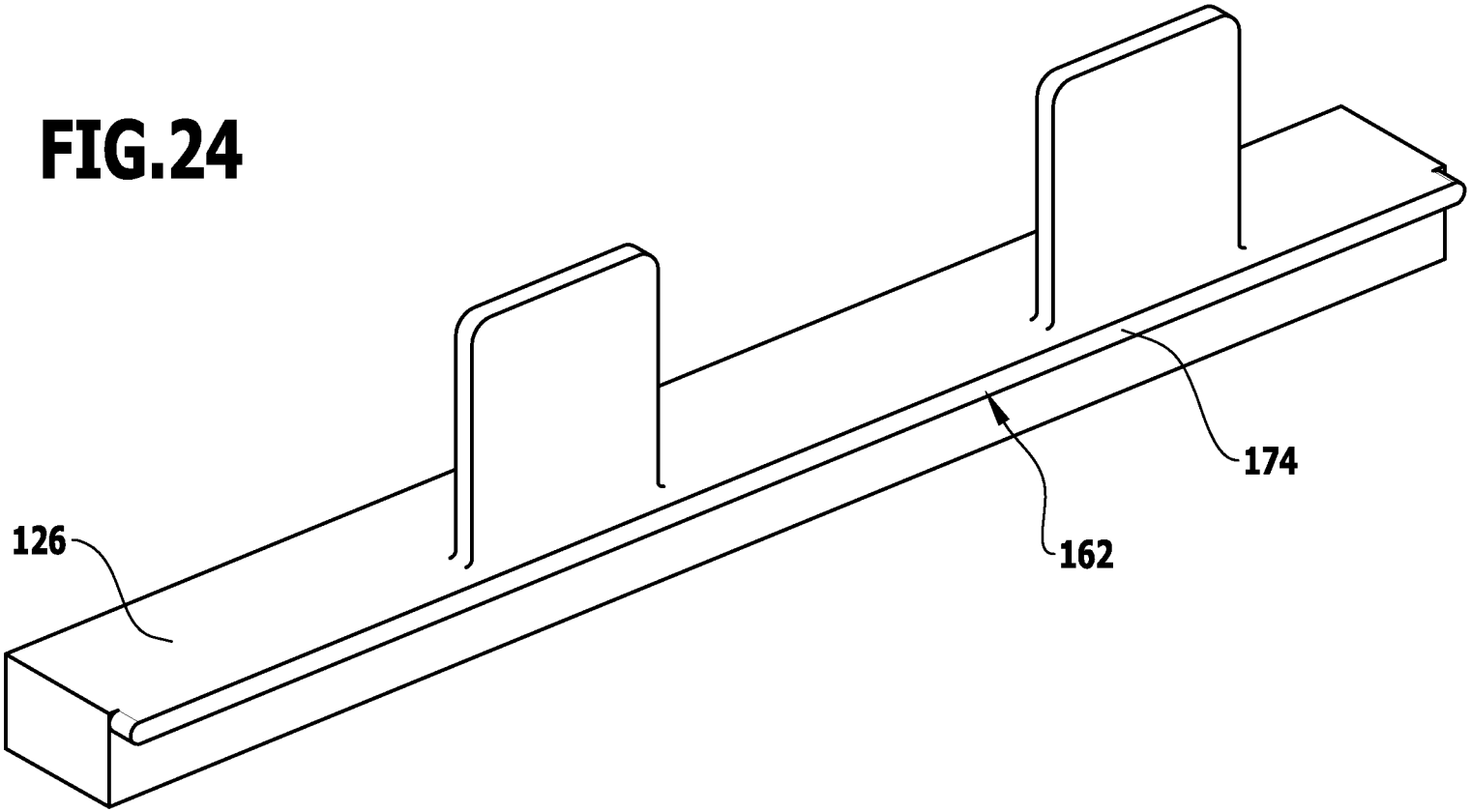
FIG. 24 shows a schematic perspective view, corresponding to FIG. 23, of an alternative embodiment of a receiving element, in which a support element, which provides support linearly, of a support device, is provided.

As an alternative to this, as shown, for example, in FIG. 24, a support element 174, which provides support substantially in a linear manner and extends, in particular, over the entire length of the receiving element 126 and therefore makes possible a reliable support of the receiving element 126, may be provided.

In the embodiment of a receiving element 126 shown in FIG. 24 it may also be provided that the support element 174 is formed in one piece with the receiving element 126.

The embodiments of receiving elements 126 shown in FIGS. 23 and 24 may basically be used in exchange for each of the described receiving elements 126.

In all the embodiments of a drawer guide 100 shown in FIGS. 11 to 24, the receiving element 126 and/or the entrainer element 140 is at least partially arranged between two limiting planes 150, 152. A compact configuration of a drawer guide 100 is thus possible.

In the embodiments of a drawer guide 100 shown, a longitudinal direction 158 is provided, which runs perpendicularly to the pull-out direction 116 and substantially parallel to at least one rail back 107, 108, 114 of at least one guide rail 102, 104, 106. Furthermore, a transverse direction 160 is provided, which runs perpendicularly to the pull-out direction 116 and perpendicularly to the longitudinal direction 158.

The limiting planes 150, 152 are, for example, oriented perpendicularly to the transverse direction 160 and parallel to the longitudinal direction 158 (see, for example, the embodiments in FIGS. 11, 14, 15, 18 and 19).

Furthermore, it may be provided that the limiting planes 150, 152 are oriented parallel to the transverse direction 160 and perpendicularly to the longitudinal direction 158 (see the embodiments in FIGS. 13 and 20)

Finally, it may be provided that the limiting planes 150, 152 run obliquely with respect to the transverse direction 160 and obliquely with respect to the longitudinal direction 158 (see the embodiments in FIGS. 12, 16 and 17).

The invention claimed is:

1. Drawer guide for the displaceable arrangement of a drawer configured to be pulled out of a carcass in a pull-out direction, comprising:

at least two guide rails, which are displaceable relative to one another along the pull-out direction by means of rolling elements, at least one functional device for influencing a relative movement of at least one of the at least two guide rails relative to at least one further one of the at least two guide rails, the at least two guide rails comprising at least two substantially C-shaped guide rails, each of the at least two substantially C-shaped guide rails having a rail back which connects at least two legs to one another, on which at least one rolling element track is configured in each case with the rolling elements arranged between two of the at least one rolling element tracks of different ones of the at least two substantially C-shaped guide rails, the at least two substantially C-shaped guide rails being arranged in such a way that the rail backs are arranged facing away from one another, and at least one receiving element to at least partially receive the at least one functional device, the at least one receiving element being arranged on an outer side, which faces away from the at least two legs of one of the at least two substantially C-shaped guide rails, of the rail back of the one of the at least two guide rails and/or on an outer side, which faces away from the at least one rolling element track, of one of the two legs of the one of the at least two guide rails, wherein:

the at least one receiving element at least partially surrounds at least one receiving space and is provided with at least one access opening, through which, in an assembled state of the drawer guide, at least one actuating element extends to actuate the at least one functional device, and the at least one functional device comprises a pull-in device for automatically bringing the drawer from an at least partially pulled-out state into a completely inserted position and/or a damping device for gently pulling the drawer into the completely inserted position.

2. Drawer guide according to claim 1, wherein the at least one receiving element, in the assembled state of the drawer guide, is at least partially arranged between two limiting planes, which are vertical in the assembled state of the drawer guide, which limiting planes run parallel to one another and parallel to the pull-out direction, a first limiting plane of the two limiting planes running through a first point located furthest to the left, viewed in the pull-out direction, of one of the at least two guide rails of the drawer guide and a second limiting plane of the two limiting planes running through a second point located furthest to the right, viewed in the pull-out direction, of a further one of the at least two guide rails of the drawer guide.

3. Drawer guide according to claim 1, wherein the at least one receiving element, in the assembled state of the drawer guide, is at least partially arranged between two limiting planes, which are horizontal in the assembled state of the drawer guide, which limiting planes run parallel to one another and parallel to the pull-out direction, a first limiting plane of the two limiting planes running through a first point located furthest up, viewed in the pull-out direction, of one of the at least two guide rails of the drawer guide, and a second limiting plane of the two limiting planes running through a second point located furthest down, viewed in the pull-out direction, of a further one of the at least two guide rails of the drawer guide.

4. Drawer guide according to claim 1, wherein the at least one receiving element is at least partially arranged between two limiting planes, which run parallel to one another, parallel to the pull-out direction and parallel to a longitudinal plane running through free edges of the at least two legs of one of the at least two guide rails, a first limiting plane of the two limiting planes running through a first point, which is spaced apart the furthest from the longitudinal plane, of one of the at least two guide rails on a first side of the longitudinal plane and a second limiting plane of the two limiting planes running through a second point, which is spaced apart the furthest from the longitudinal plane, of a further one of the at least two guide rails on a second side of the longitudinal plane opposite the first side of the longitudinal plane.

5. Drawer guide according to claim 1, wherein the at least one receiving element has a substantially L-shaped cross-section taken perpendicular to the pull-out direction.

6. Drawer guide according to claim 1, wherein the at least one access opening for the at least one receiving space is formed in an upper, a lower and/or a lateral limiting wall of the at least one receiving element, which limiting wall, in the assembled state of the drawer guide, upwardly limits the at least one receiving space in a vertical direction, limits it downwardly in the vertical direction and/or limits it laterally in a horizontal direction.

7. Drawer guide according to claim 1, wherein the at least one actuating element is movable along the at least one access opening to actuate the at least one functional device in the assembled state of the drawer guide.

8. Drawer guide according to claim 1, wherein the rolling elements of the drawer guide, for mounting at least one of the at least two guide rails on at least one further one of the at least two guide rails, are made of at least one of a metallic material and a plastics material.

9. Drawer guide according to claim 1, further comprising at least one entrainer element, which is configured to be made to engage with the at least one actuating element to actuate the at least one functional device.

10. Drawer guide according to claim 9, wherein the at least one receiving element and the at least one entrainer element are arranged on respectively different ones of the at least two guide rails.

11. Drawer guide according to claim 9, wherein the at least one entrainer element is arranged on the rail back of at least one of the at least two substantially C-shaped guide rails and/or on at least one of the at least two legs of at least the one of the at least two substantially C-shaped guide rails.

12. Drawer guide according to claim 9, wherein:

the at least one receiving element is arranged between limiting planes; and the at least one entrainer element is arranged, at least in portions, between the limiting planes.

13. Drawer guide according to claim 1, wherein the at least one receiving element cooperates with at least one component of the at least one functional device to influence a relative movement of at least one of the at least two guide rails relative to at least one further one of the at least two guide rails.

14. Drawer guide according to claim 1, wherein the at least one receiving element forms a housing, which is configured to be used for the selective receiving of different types of the at least one functional device.

15. Drawer guide according to claim 1, further comprising a support device for supporting the at least one receiving element, at least one entrainer element, and/or at least one actuating element on the carcass, on the drawer and/or on at least one of the at least two guide rails.

* * * * *